United States Patent [19]

Okamura et al.

[11] Patent Number: 4,863,841

[45] Date of Patent: Sep. 5, 1989

[54] SILVER HALIDE COLOR PHOTOGRAPHIC MATERIAL

[75] Inventors: Hisashi Okamura; Hidetoshi Kobayashi; Toshihiro Nishikawa; Koji Tamoto, all of Kanagawa, Japan

[73] Assignee: Fuji Photo Film Co., Ltd., Kanagawa, Japan

[21] Appl. No.: 310,016

[22] Filed: Feb. 13, 1989

Related U.S. Application Data

[63] Continuation of Ser. No. 732,762, May 10, 1985, abandoned.

[30] Foreign Application Priority Data

May 10, 1984 [JP] Japan ..... 59-93603

[51] Int. Cl.[4] ..... G03C 1/08; G03C 7/26; G03C 1/30; G03C 7/32

[52] U.S. Cl. ..... 430/555; 430/621; 430/623

[58] Field of Search ..... 430/555, 623, 621

[56] References Cited

U.S. PATENT DOCUMENTS

| | | | |
|---|---|---|---|
| 4,010,035 | 3/1977 | Fujiwhara et al. | 430/555 |
| 4,063,952 | 12/1977 | Himmelmann et al. | 430/623 |
| 4,119,464 | 10/1978 | Sauerteig et al. | 430/623 |
| 4,123,281 | 10/1978 | Monbaliu et al. | 430/623 |
| 4,233,398 | 11/1980 | Nittel et al. | 430/623 |
| 4,418,142 | 11/1983 | Langen et al. | 430/623 |
| 4,421,847 | 12/1983 | Jung et al. | 430/623 |
| 4,543,324 | 9/1985 | Himmelmann | 430/623 |
| 4,554,247 | 11/1985 | Yamashita et al. | 430/623 |
| 4,555,479 | 11/1985 | Sakai et al. | 430/555 |
| 4,584,266 | 4/1986 | Hirose et al. | 430/555 |
| 4,609,620 | 9/1986 | Postle et al. | 430/555 |
| 4,612,280 | 9/1986 | Okamura et al. | 430/623 |
| 4,618,573 | 10/1986 | Okamura et al. | 430/623 |

*Primary Examiner*—Mukund J. Shah

*Attorney, Agent, or Firm*—Sughrue, Mion, Zinn, Macpeak & Seas

[57] ABSTRACT

A silver halide color photographic material comprising a support having thereon at least one photosensitive silver halide emulsion layer, wherein a 5-pyrazolone type 2-equivalent coupler is present in the photosensitive silver halide emulsion layer or a layer adjacent thereto and a hardening agent which acts by activating a carboxy group is present in a photosensitive or non-photosensitive photographic layer of the silver halide color photographic material.

13 Claims, No Drawings

SILVER HALIDE COLOR PHOTOGRAPHIC MATERIAL

This is continuation of application Ser. No. 732,762 filed May 10, 1985 now abandoned.

FIELD OF THE INVENTION

This invention relates to a silver halide color photographic material containing a quick acting hardening agent and a 5-pyrazolone type 2-equivalent magenta coupler.

BACKGROUND OF THE INVENTION

Color images are usually obtained by the reaction of the oxidation product of silver halide and an aromatic primary amine color developing agent with dye forming compounds known as couplers in conventional photographic techniques. By the reaction of the coupler and the oxidation product of a color developing agent, the oxidized color developing agent is coupled at the coupling position of the coupler to form a dye. The dyes formed by coupling are indoaniline dyes, azomethine dyes, indamine dyes, or indophenol dyes, according to the chemical compositions of the coupler and the developing agent.

In a multicolor photographic element, a subtractive color photographic process is usually employed for the formation of color images and the dyes formed by coupling are usually cyan, magenta and yellow dyes formed in silver halide emulsion layers having light sensitivity for radiation absorbed by image dyes, that is, silver halide emulsion layers having light sensitivity in the red spectral region, the green spectral region, and the blue spectral region, respectively, or layers adjacent to these emulsion layers.

For shortening the processing time for color photographic materials, color photographic materials are processed at temperatures higher than normal temperatures (20° to 25° C.), and at present are usually processed at temperatures higher than 30° C. However, in a high temperature quick processing, a hydrophilic colloid such as, for example, gelatin in which silver halide, a color coupler, and other additives are dispersed is softened and swelled, whereby the emulsion layer is easily damaged or peeled off from the support. Accordingly, silver halide emulsion layers must be hardened to withstand high temperature processing. Hardening of emulsion layers is attained by introducing a photographic material having the emulsion layers in a hardening bath during development processing or incorporating a hardening agent such as formaldehyde, dialdehyde, mucochloric acid, etc., in silver halide emulsions during the preparation thereof.

It is important for hardening photographic layers to attain the maximum hardness as quickly as possible after drying in order to minimize the change of permeability of a developer.

Recently, it has become important to use a hardening agent which acts quickly (e.g., within about one day) for photographic purposes in place of a hardening agent which acts over a long period of time (e.g., over about one day, such as 2 weeks). By the quick speed of the hardening reaction, the change of photographic materials during the storage thereof can be avoided and also the continuous reduction of the permeability of the emulsion layers for a developer can be avoided.

The quick acting hardening agent is a compound capable of completing a cross-linked bond of gelatin in a very short period of time, if possible during coating and drying emulsion layers. The maximum cross-linked bond is attained within 24 hours.

Useful quick acting hardening agents include, for example, carbodiimides as reported in Erich Schmidt, Fritz Hitzles, Eberhard Lahde, *Berichte der Deutschen Chemischen Gesellschaft,* Vol. 71 II, p. 1933 (1938) and *Bull. Soc. Chim. France,* p. 1360 (1956); dihydroquinone compounds as described in German Patent Application (OLS) No. 2,322,317; carbamoylpyridinium compounds as described in German Patent Application (OLS) Nos. 2,225,230, 2,317,677 and 2,439,551; and carbamoyloxypyridinium compounds as described in German Patent Application (OLS) No. 2,408,814.

One of the features common to these whole quick acting hardening agents is that a carboxy group is activated. This action can be shown by a known reaction example of carbodiimide and a carboxylic acid. In the reaction, N-acylurea or an acid anhydride is used as the active group. In the case of a carboxy group and protein having an amino group, the reaction further proceeds and the activated carboxy group forms a peptide bond with the amino group. Such a compound is, therefore, known as a peptide reagent (*Chemical Review,* Vol. 67, pp. 107 to 152 (1967)).

However, such a type of compound reduces development cf a magenta layer, which therefore restricts the utilization of the compound as a quick acting hardening agent for color photographic materials.

SUMMARY OF THE INVENTION

The object of this invention, therefore, is to provide a color photographic material containing a quick acting hardening agent, in which the formation of magenta images is scarcely spoiled or is not spoiled by the quick hardening of the color photographic material before photographic processing.

It has now been discovered that the abovedescribed object of this invention can be attained by a silver halide color photographic material comprising a support having thereon at least one photosensitive silver halide emulsion layer, wherein a 5-pyrazolone type 2-equivalent coupler is present in the photosensitive silver halide emulsion layer or a layer adjacent thereto and a hardening agent which acts by activating a carboxy group is present in a photosensitive or non-photosensitive photographic layer of the silver halide color photographic material.

DETAILED DESCRIPTION OF THE INVENTION

Since the magenta coupler for use in this invention is a 5-pyrazolone type 2-equivalent coupler rather than a 4-equivalent coupler, it is very unlikely to undergo a side reaction with the quick acting hardening agent, and thus the formation of magenta images is scarcely spoiled or is not spoiled.

The 5-pyrazolone 2-equivalent magenta coupler for use in this invention is preferably represented by formula (A)

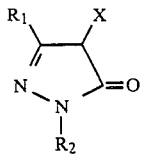

(A)

wherein $R_1$ represents a carbonamido group, an anilino group or a ureido group; $R_2$ represents an aryl group, e.g., an unsubstituted or substituted phenyl group; and X represents a group capable of being released by the coupling reaction with the oxidation product of an aromatic primary amine developing agent (hereinafter, such a group is referred to as a releasable group).

Examples of X include a group bonding a coupling active carbon and an aliphatic group, an aromatic group, a heterocyclic group, an aliphatic, aromatic or heterocyclic sulfonyl group, an aliphatic, aromatic or heterocyclic carbonyl group, a carbamoyl group, an alkoxycarbonyl group, or an aryloxycarbonyl group through an oxygen atom, a nitrogen atom, a sulfur atom, or a carbon atom; a halogen atom; an aromatic azo group; a heterocyclic group, etc.

The aliphatic, aromatic, or heterocyclic groups included in X and the groups shown by $R_1$ and $R_2$ may be substituted by a substituent such as, for example, a halogen atom (e.g., a fluorine atom, a chlorine atom, a bromine atom, etc.), an alkyl group (e.g., a methyl group, a t-octyl group, a dodecyl group, a trifluoromethyl group, etc.), an alkenyl group (e.g., an allyl group, an octadecenyl group, etc.), an aryl group (e.g., a phenyl group, a p-tolyl group, a naphthyl group, etc.), an alkoxy group (e.g., a methoxy group, a benzyloxy group, a methoxyethoxy group, etc.), an aryloxy group (e.g., a phenoxy group, a 2,4-di-tert-amylphenoxy group, a 3-tert-butyl-4-hydroxyphenoxy group, etc.), an acyl group (e.g., an acetyl group, a benzoyl group, etc.), a sulfonyl group (e.g., a methanesulfonyl group, a toluenesulfonyl group, etc.), a carboxy group, a sulfo group, a cyano group, a hydroxy group, an amino group (e.g., an amino group, a dimethylamino group, etc.), a carbonamido group (e.g., an acetamido group, a trifluoroacetamido group, a tetradecanamido group, a benzamido group, etc.), a sulfonamido group (e.g., a methanesulfonamido group, a hexadecanesulfonamido group, a p-toluenesulfonamido group, etc.), an acyloxy group (e.g., an acetoxy group, etc.), a sulfonyloxy group (e.g., a methanesulfonyloxy group, etc.), an alkoxycarbonyl group (e.g., a dodecyloxycarbonyl group, etc.), an aryloxycarbonyl group (e.g., a phenoxycarbonyl group, etc.), a carbamoyl group (e.g., a dimethylcarbamoyl group, a tetradecylcarbamoyl group, etc.), a sulfamoyl group (e.g., a methylsulfamoyl group, a hexadecylsulfamoyl group, etc.), an imido group (e.g., a succinimido group, a phthalimido group, an octadecenylsuccinimido group, etc.), a heterocyclic group (e.g., a 2-pyridyl group, a 2-furyl group, a 2-thienyl group, etc.), an alkylthio group (e.g., a methylthio group, etc.), and an arylthio group (e.g., a phenylthio group, etc.).

Specific examples of X include a halogen atom (e.g., a fluorine atom, a chlorine atom, a bromine atom, etc.), an alkoxy group (e.g., a benzyloxy group, etc.), an aryloxy group (e.g., a 4-chlorophenoxy group, a 4-methoxyphenoxy group, etc.), an acyloxy group (e.g., an acetoxy group, a tetradecanoyloxy group, a benzoyloxy group, etc.), an aliphatic or aromatic sulfonyloxy group (e.g., a methanesulfonyloxy group, a toluenesulfonyloxy group, etc.), a carbonamido group (e.g., a dichloroacetamido group, a trifluoroacetamido group, etc.), an aliphatic or aromatic sulfonamido group (e.g., a methanesulfonamido group, a p-toluenesulfonamido group, etc.) an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic, aromatic or heterocyclic thio group (e.g., an ethylthio group, a hexadecylthio group, a 4-dodecylphenylthio group, a pyridylthio group, etc.), a ureido group (e.g., a methylureido group, a phenylureido group, etc.), a 5-membered or 6-membered nitrogen-containing heterocyclic group (e.g., an imidazolyl group, a pyrazolyl group, a triazolyl group, a tetrazolyl group, a 1,2-dihydro-2-oxo-1-pyridyl group, etc.), an imido group (e.g., a succinimido group, a phthalimido group, a hydantoinyl group, etc.), an aromatic azo group (e.g., a phenylazo group, etc.), etc.

Also, examples of the coupler having the releasable group through a carbon atom for X include a so-called bis type coupler obtained by condensing a 4-equivalent coupler with an aldehyde or a ketone.

Any one of $R_1$, $R_2$ and X may be a divalent or a more polyvalent group to form an oligomer such as a dimer, etc., or may connect a polymeric main chain and a coupler skeleton to form a polymeric coupler.

Also, the coupler shown by formula (A) has ketoenol form tautomerism as described below:

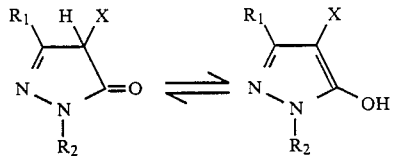

Examples of the compound represented by formula (A) and synthesis methods for these compounds are described, for example, in Japanese Patent Application (OPI) Nos. 111631/74, 48540/79, 62454/80, 118034/80, 38043/81, 80045/81, 126833/81, 4044/82, 35858/82, 94752/82, 17440/83, 50537/83, 85432/83, 117546/83, 126530/83, 145944/83, 205151/83, 170/79, 10491/79, 21258/79, 46452/78, 46453/78, 36577/82, 2953/85 and 23855/85 (the term "OPI" as used herein refers to a "published unexamined Japanese patent application open to public inspection"), U.S. Pat. Nos. 3,227,554, 3,432,521, 4,310,618, 4,351,897, etc.

Preferred examples of the 5-pyrazolone 2-equivalent magenta coupler represented by formula (A) are illustrated below.

(M-1)
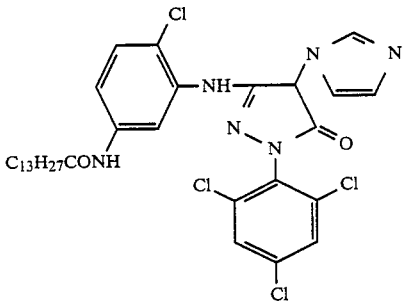
(M-2)
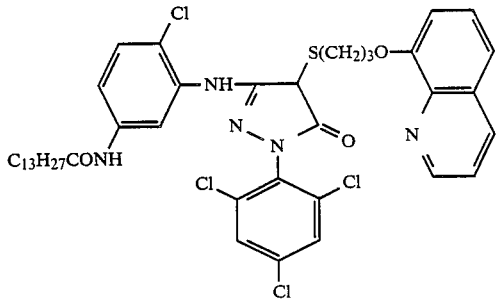
(M-3)
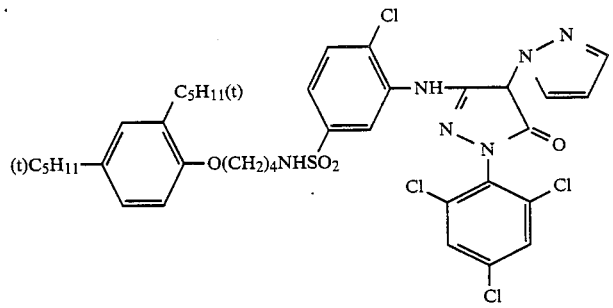
(M-4)
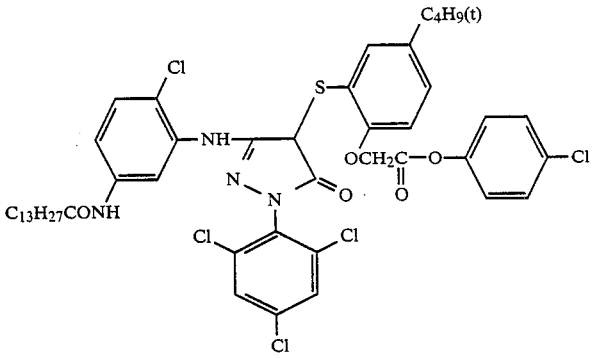
(M-5)
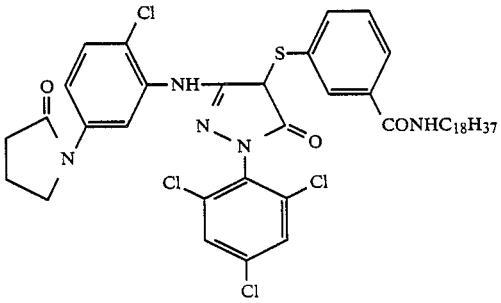

-continued
(M-6)
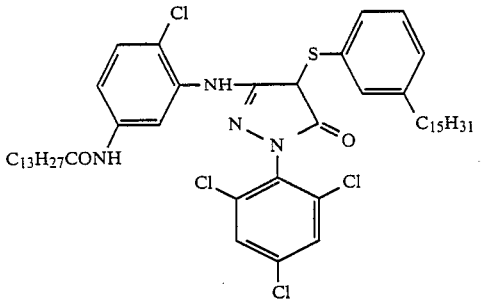
(M-7)
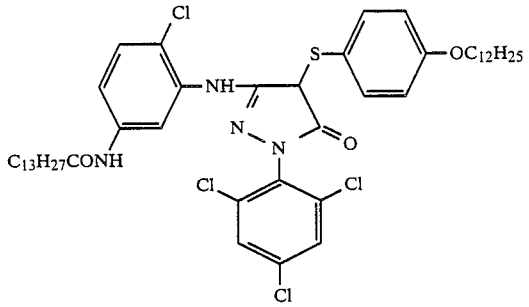
(M-8)
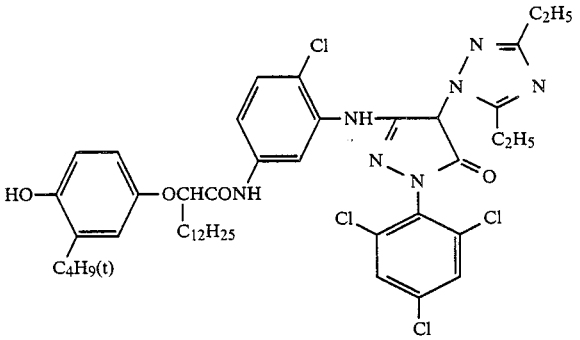
(M-9)
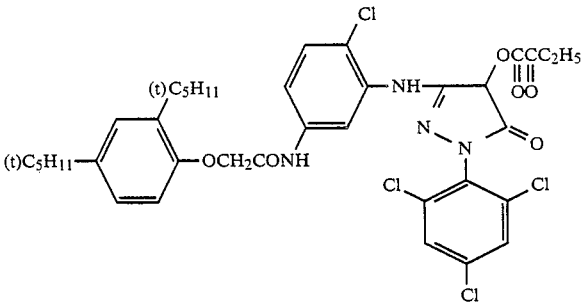
(M-10)
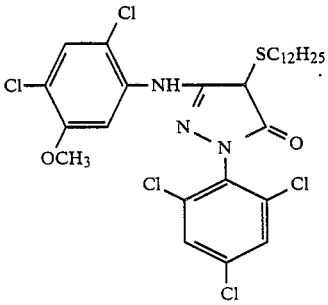

-continued
(M-11)
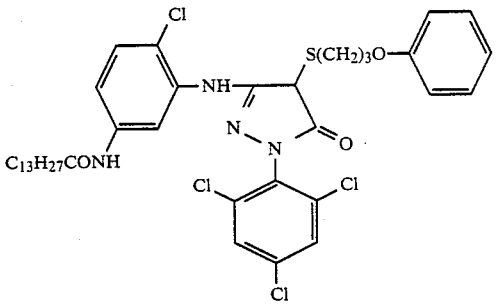
(M-12)
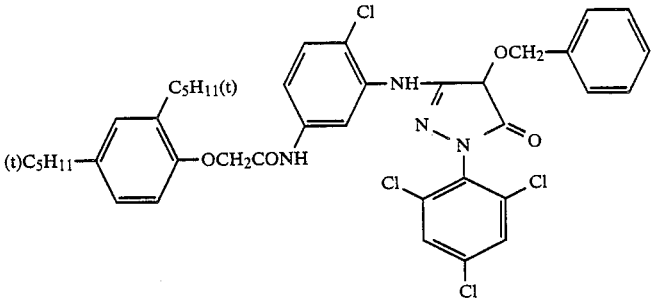
(M-13)
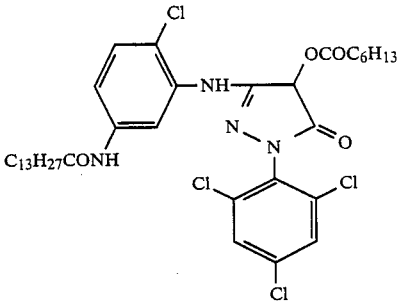
(M-14)
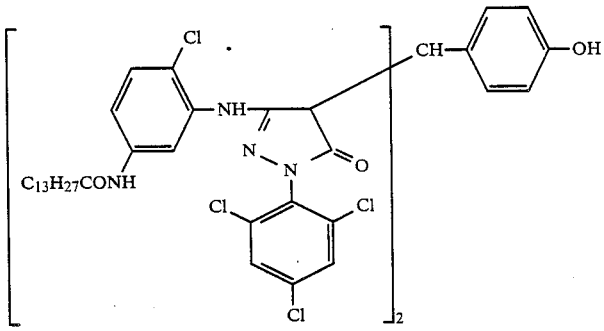
(M-15)
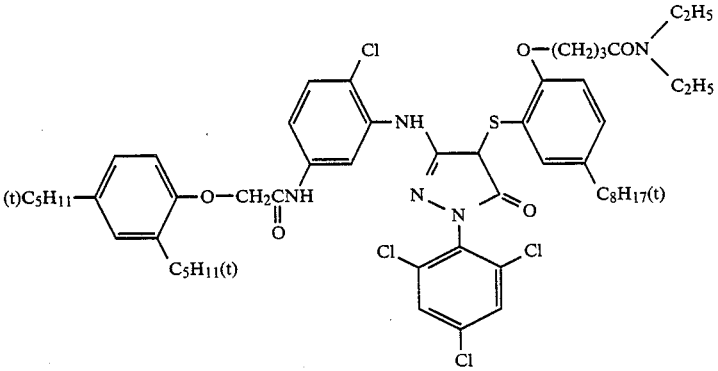

-continued
(M-16)
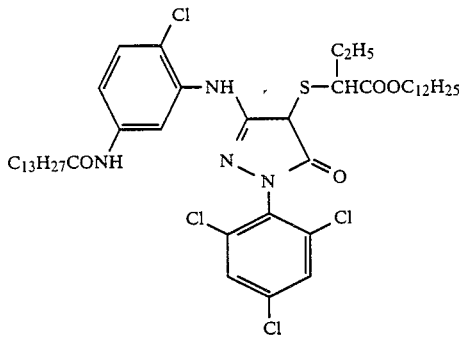
(M-17)
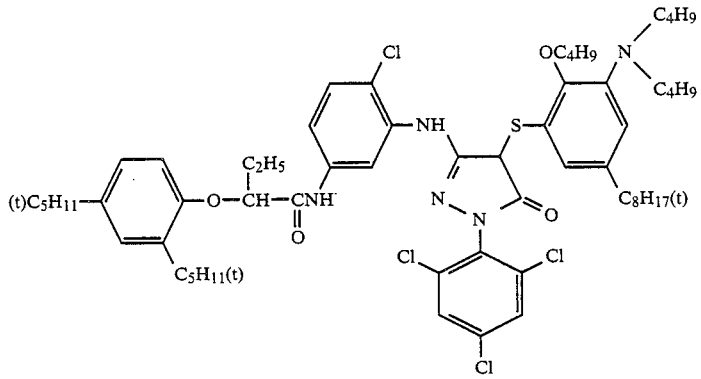
(M-18)
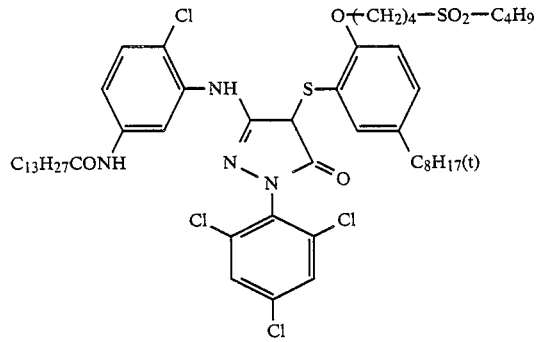
(M-19)
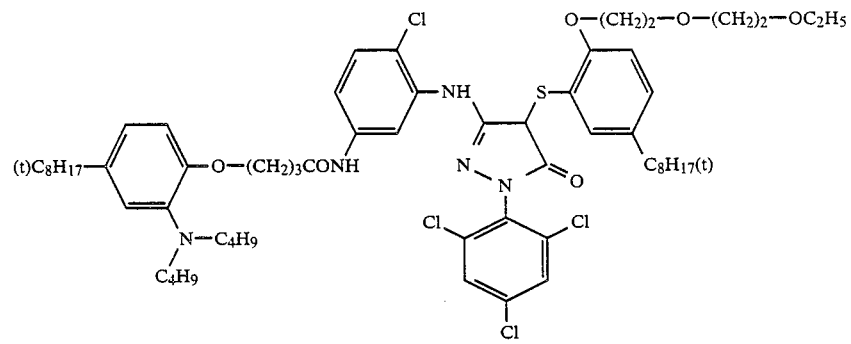
Preferred examples of the carboxy group-active type hardening agent for use in this invention are the compounds represented by formulae (I) to (VI) described hereinbelow.
Formula (I) is as follows,
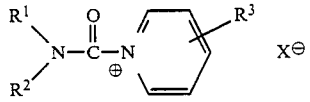
(I)
wherein $R^1$ and $R^2$ (which may be the same or different) each represents an alkyl group having from 1 to 10 carbon atoms (e.g., a methyl group, an ethyl group, a 2-ethylhexyl group, etc.), an aryl group having from 6 to 15 carbon atoms (e.g., a phenyl group, a naphthyl group, etc.), or an aralkyl group having from 7 to 15 carbon atoms (e.g., a benzyl group, a phenethyl group, etc.). Also, it is preferred that said $R^1$ and $R^2$ combine with each other to form a heterocyclic ring together with a nitrogen atom. Examples of forming a ring are a pyrrolidine ring, a piperazine ring, a morpholine ring, etc.

$R^3$ in formula (I) represents a substituent such as a hydrogen atom, a halogen atom, a carbamoyl group, a sulfo group, a ureido group, an alkoxy group having from 1 to 10 carbon atoms, an alkyl group having from 1 to 10 carbon atoms, etc. When $R^3$ is an alkoxy group or an alkyl group, these groups may be substituted by a substituent such as a halogen atom, a carbamoyl group, a sulfo group, or a ureido group.

$X^{\ominus}$ in formula (I) represents an anion and becomes a pair ion for the N-carbamoylpyridinium salt. When the hardening agent of formula (I) forms an intramolecular salt, said $X^{\ominus}$ is not necessary. Examples of the anion represented by $X^{\ominus}$ are a halide ion, a sulfate ion, a sulfonate ion, $ClO_4^{\ominus}$, $BF_4^{\ominus}$, $PF_6^{\ominus}$, etc.

Formula (II) is as follows,

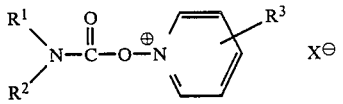

(II)

wherein $R^1$, $R^2$, $R^3$ and $X^{\ominus}$ have the same meanings as defined for formula (I).

Formula (III) is as follows,

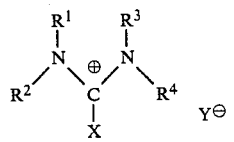

(III)

wherein $R^1$, $R^2$, $R^3$ and $R^4$ (which may be the same or different) each represents an alkyl group having from 1 to 20 carbon atoms (e.g., a methyl group, an ethyl group, a butyl group, a 2-ethylhexyl group, a dodecyl group, etc.), an aralkyl group having from 6 to 20 carbon atoms (e.g., a benzyl group, a phenethyl group, a 3-pyridylmethyl group, etc.), or an aryl group having from 5 to 20 carbon atoms (e.g., a phenyl group, a naphthyl group, a pyridyl group, etc.). The groups shown by $R^1$, $R^2$, $R^3$ and $R^4$ may have a substituent such as a halogen atom, a sulfo group, an alkoxy group having from 1 to 20 carbon atoms, an aryl group having from 6 to 20 carbon atoms, or an N,N-di-substituted carbamoyl group.

Also, it is preferred that any two groups of said $R^1$, $R^2$, $R^3$ and $R^4$ can together form a ring. For example, examples of the ring formed by the combination of $R^1$ and $R^2$ or $R^3$ and $R^4$ together with a nitrogen atom include a pyrrolidine ring, a piperazine ring, a perhydroazepine ring, a morpholine ring, etc. Also, examples of the ring formed by the combination of $R^1$ and $R^3$ or $R^2$ and $R^4$ together with two nitrogen atoms and a carbon atom disposed between the nitrogen atoms include an imidazoline ring, a tetrahydropyrimidine ring, a tetrahydroazepine ring, etc.

X in formula (III) represents a group capable of being released when the compound shown by formula (III) reacts with a nucleophilic reagent and specific examples of X include a halogen atom, a sulfonyloxy group, a 1-pyridiniumyl group, etc. $Y^{\ominus}$ represents an anion such as, preferably, a halide ion, a sulfonate ion, a sulfate ion, $ClO_4^{\ominus}$, $BF_4^{\ominus}$, $PF_6^{\ominus}$, etc. When any one of $R^1$, $R^2$, $R^3$ and $R^4$ has a sulfo group, a hardening agent having the formula (III) can form an intramolecular salt without any independent counter anion represented by $Y^{\ominus}$.

Formula (IV) is as follows, $$R^1-N=C=N-R^2 \qquad \text{(IV)}$$

wherein $R^1$ represents an alkyl group having from 1 to 10 carbon atoms (e.g., a methyl group, an ethyl group, a 2-ethylhexyl group, etc.), a cycloalkyl group having from 5 to 8 carbon atoms (e.g., a cyclohexyl group, etc.), an alkoxyalkyl group having 3 to 10 carbon atoms (e.g., a methoxyethyl group, etc.) or an aralkyl group having from 7 to 15 carbon atoms (e.g., a benzyl group, a phenethyl group, etc.).

$R^2$ in formula (IV) above represents the same group as defined in regard to $R^1$, as well as preferably a group shown by

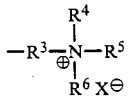

[wherein $R^3$ represents an alkylene group having from 2 to 4 carbon atoms (e.g., an ethylene group, a propylene group, a trimethylene group, etc.); $R^4$ and $R^5$ (which may be the same or different) each represents an alkyl group having from 1 to 6 carbon atoms (e.g., a methyl group, an ethyl group, etc.), or said $R^4$ and $R^5$ may combine with each other to form, preferably, a heterocyclic ring (e.g., a pyrrolidine ring, a piperazine ring, a morpholine ring, etc.) together with a nitrogen atom; $R^6$ represents an alkyl group having from 1 to 6 carbon atoms (e.g., a methyl group, an ethyl group, a butyl group, etc.) and the group shown by $R^4$, $R^5$ or $R^6$ may, preferably, have a substituent such as a substituted or unsubstituted carbamoyl group, a sulfo group, etc.; and $X^{\ominus}$ represents an anion such as, preferably, a halide ion, a sulfonate ion, a sulfate ion, $ClO_4^{\ominus}$, $BF_4^{\ominus}$, $PF_6^{\ominus}$, etc.]. When the hardening agent of formula (IV) forms an intramolecular salt, the counter anion represented by $X^{\ominus}$ is not necessary.

Formula (V) is as follows,

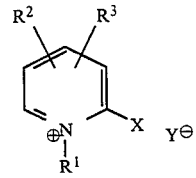

(V)

wherein $R^1$ represents an alkyl group having from 1 to 10 carbon atoms (e.g., a methyl group, an ethyl group, a butyl group, etc.), an aryl group having from 6 to 15 carbon atoms (e.g., a phenyl group, a naphthyl group, etc.), or an aralkyl group having from 7 to 15 carbon atoms (e.g., a benzyl group, a phenethyl group, etc.). These groups for $R^1$ may have a substituent such as a carbamoyl group, a sulfamoyl group, a sulfo group, etc.

$R^2$ and $R^3$ in formula (V), which may be the same or different, each represents a substituent such as a hydrogne atom, a halogen atom, an acylamido group, a nitro group, a carbamoyl group, a ureido group, an alkoxy group, an alkyl group, an alkenyl group, an aryl group, an aralkyl group, etc. Also, said $R^2$ and $R^3$ may combine with each other to form, preferably, a condensed ring with the pyridinium ring skeleton.

X in formula (V) represents a group capable of being released when the compound represented by formula (V) reacts with a nucleophilic reagent and preferred examples of X are a halogen atom, a sulfonyloxy group, or a group represented by $$-\underset{\underset{O}{\|}}{P}(OR^4)_2$$

(wherein $R^4$ represents an alkyl group or an aryl group). When X represents a sulfonyloxy group, it is preferred that X and $R^1$ combine with each other.

$Y^{\ominus}$ in formula (V) represents an anion such as, preferably, a halide ion, a sulfonate ion, a sulfate ion, $ClO_4^{\ominus}$, $BF_4^{\ominus}$, $PF_6^{\ominus}$, etc. Also, when $R^1$ is substituted by a sulfo group, the above compound may form an intramolecular salt and $Y^{\ominus}$ may not exist.

Formula (VI) is as follows,

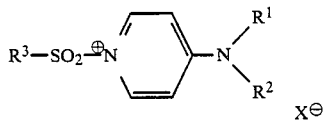

(VI)

wherein $R^1$ and $R^2$ have the same meanings as $R^1$ and $R^2$ in formula (I); $R^3$ represents an alkyl group having from 1 to 10 carbon atoms (e.g., a methyl group, an ethyl group, a butyl group, etc.), an aryl group having 6 to 15 carbon atoms (e.g., a phenyl group, a naphthyl group, etc.), or an aralkyl group having from 7 to 15 carbon atoms (e.g., a benzyl group, a phenethyl group, etc.). $X^{\ominus}$ in formula (VI) represents an anion such as, preferably, a halide ion, a sulfonate ion, a sulfate ion, $ClO_4^{\ominus}$, $BF_4^{\ominus}$, $PF_6^{\ominus}$, etc.

Additional carboxy group-active type hardening agents useful in this invention include compounds as described in Japanese Patent Application (OPI) Nos. 38540/75, 93470/77, 43353/81 and 113929/83 and U.S. Pat. No. 3,321,313, in addition to compounds represented by the above-described formulae (I) to (VI).

Practical example of the carboxy group-active type hardening agent for use in this invention are illustrated below in classified groups, but the invention is not limited to these compounds.

(a) Compounds represented by formula (I)

(Synthesis methods for such compounds are described in detail, e.g., in Japanese Patent Application (OPI) Nos. 51945/74 and 59625/76.)

H-1

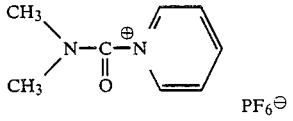

-continued

H-2

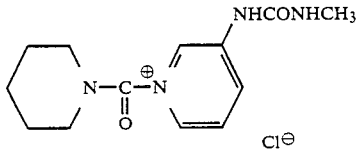

H-3

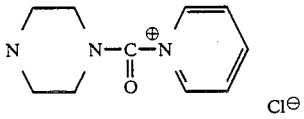

H-4

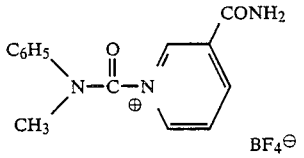

H-5

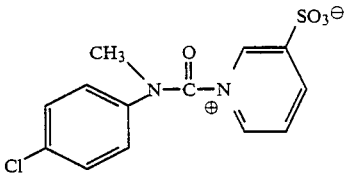

H-6

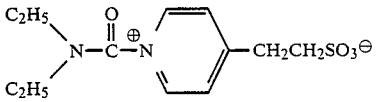

H-7

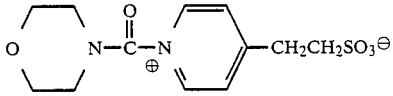

H-8

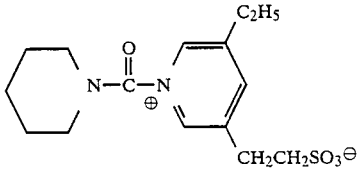

(b) Compounds represented by formula (II)

(Synthesis methods for such compounds are described in detail, e.g., in Belgian Patent No. 825,726.)

H-9

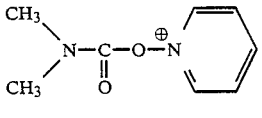

H-10

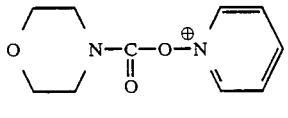

H-11

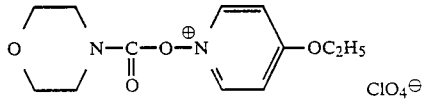

-continued

H-12

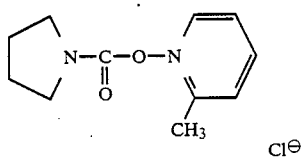

H-13

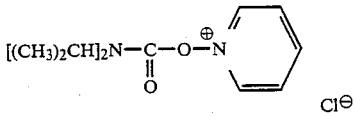

(c) Compounds represented by formula (III)

(Synthesis methods of these compounds are described in detail, e.g., in *Chemistry Letters,* (The Chemical Society of Japan), pp. 1891–1894 (1982).)

H-14

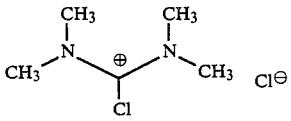

H-15

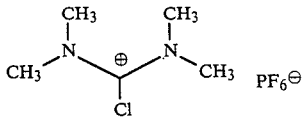

H-16

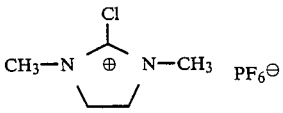

H-17

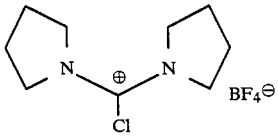

H-18

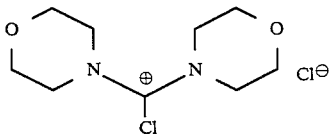

H-19

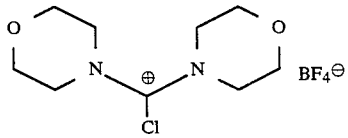

H-20

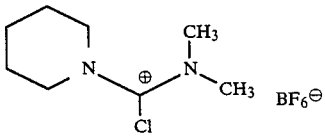

H-21

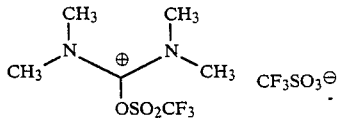

(d) Compounds represented by formula (IV)

(Synthesis methods for such compounds are described in detail, e.g., in Japanese Patent Application (OPI) Nos. 126125/76 and 48311/77.)

H-22

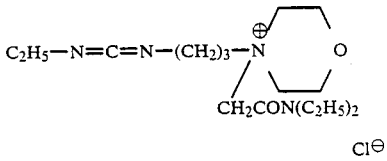

H-23

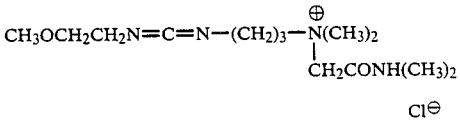

H-24

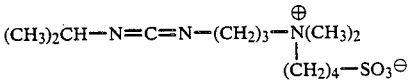

H-25

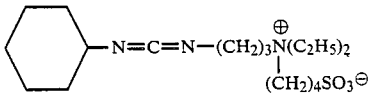

H-26

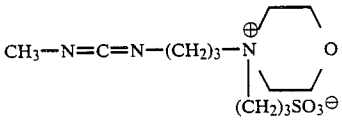

H-27

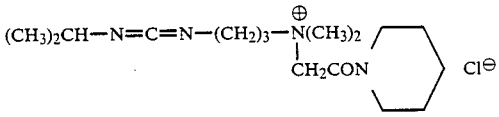

H-28

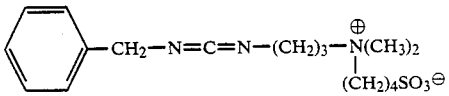

(e) Compounds represented by formula (V)

(Synthesis methods for such compounds are described in detail, e.g., in Japanese Patent Application (OPI) Nos. 44140/82 and 46538/82 and Japanese Patent Application No. 50669/83.)

H-29

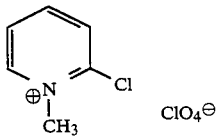

H-30

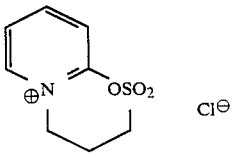

-continued

H-31

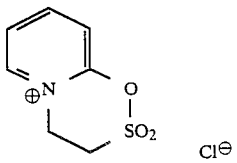

H-32

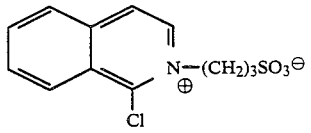

H-33

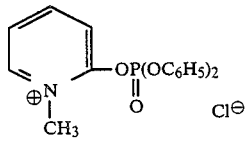

H-34

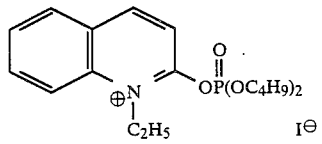

(f) Compounds represented by formula (VI) (Synthesis methods for such compounds are described in detail, e.g., in Japanese Patent Application (OPI) No. 54427/77.)

H-35

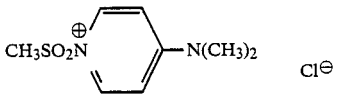

H-36

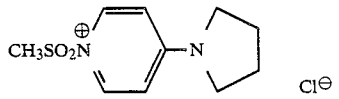

H-37

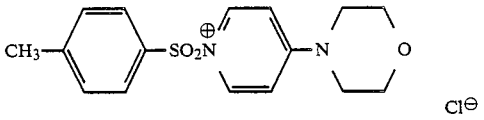

(g) Compounds as described in Japanese Patent Application (OPI) No. 38540/75.

H-38

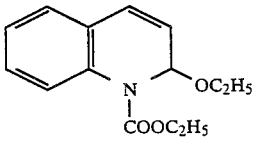

H-39

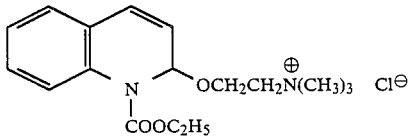

-continued

H-40

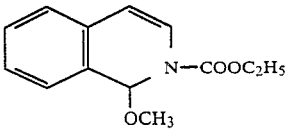

(h) Compounds as described in Japanese Patent Application (OPI) No. 93470/77

H-41

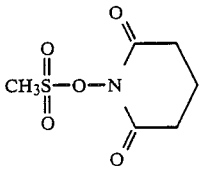

H-42

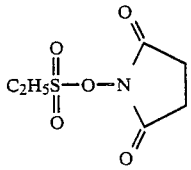

(i) Compounds as described in Japanese Patent Application (OPI) No. 43353/81

H-43

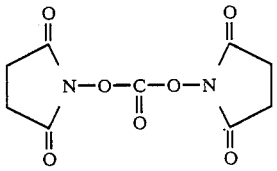

H-44

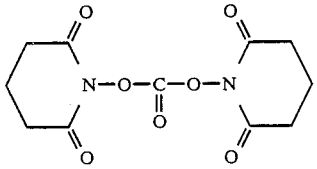

H-45

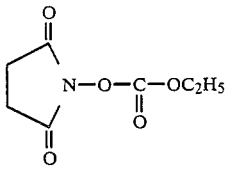

(j) Compounds as described in Japanese Patent Application (OPI) No. 113929/83

H-46

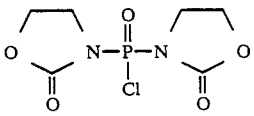

H-47

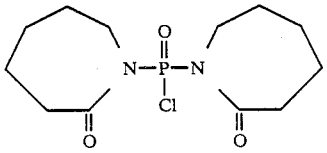

(k) Compounds as described in U.S. Pat. No. 3,321,313

H-48

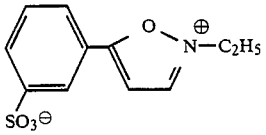

H-49

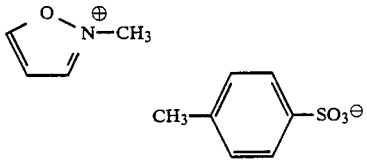

H-50

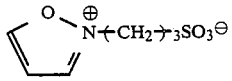

H-51

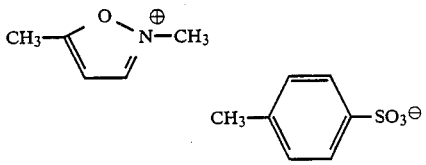

H-52

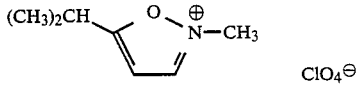

H-53

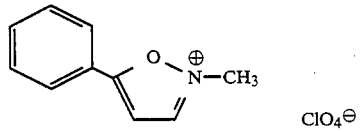

H-54

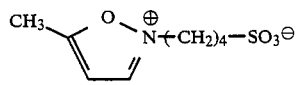

When the hardening agents represented by aforesaid formulae (I) to (VI) are used for photographic layers of silver halide color photographic materials, undesirable phenomena such as the reduction in photographic properties (e.g., formation of fog, occurrence of desensitization, etc.), the formation of stains, the reaction with couplers contained in the color photographic materials, etc., are scarcely observed. Also, hardening by the hardening agent proceeds very quickly and reaches the final hardened degree in only few days after coating the photographic layers, and post-hardening, that is, the phenomenon that hardening increases thereafter, is not substantially observed.

These hardening agents have an excellent affinity for water, and do not require any specific organic solvent for coating, and hence troubles such as unevenness in coating caused by the use of organic solvent, etc., do not occur in the case of using the hardening agents. Also, it becomes unnecessary to pay specific care for the prevention of explosions, which must be considered in the case of using organic solvent. Moreover, since these compounds show no specific physiological action and have low vapor pressure, adverse influences thereof on the human body are less.

The amount of the hardening agent for use in this invention is not particularly limited, but can be selected according to the intended purposes, and is generally preferably in the range of from 0.01 to 20% by weight with respect to the weight of the dry gelatin in the photographic layer. The amount thereof is particularly preferably in the range of from 0.05 to 10% by weight.

The hardening agent for use in this invention can also be effectively used as a hardening agent for partial hardening in the method of prolonging the chain length of gelatin by partially hardening as described in Japanese Patent Application (OPI) No. 2324/81. Furthermore, the hardening agent can also be used for hardening such a chain length prolonged gelatin.

The hardening agents for use in this invention can be used for any photographic material using gelatin. For example, the hardening agents can be used for color photographic materials such as color photographic negative films, color photographic reversal films, color photographic positive films, color photographic papers, color photographic reversal papers, and color photographic materials for a color diffusion transfer system and a silver dye bleach system, and for black-and-white photographic materials such as black-and-white photographic films, radiographic films, graphic films, balck-and-white photographic papers, navigational photographic films, microfilms, facsimile films, photocomposing films or papers, graph films, etc.

Also, in these cases, there is no particular restriction on the photographic layers to which the hardening agents in this invention are applied, and the hardening agents can be used not only for silver halide emulsion layers, but also non-photosensitive layers containing gelatin, such as subbing layers, backing layers, filter layers, interlayers, overcoat layers, etc.

The hardening agents for use in this invention may be used individually or as a mixture thereof, or further may be used with other known hardening agent such as aldehyde series compounds (e.g., formaldehyde, glutaraldehyde, etc.), ketone compounds (e.g., diacetyl, cyclopentanedione, etc.), bis(2-chloroethylurea), 2-hydroxy-4,6-dichloro-1,3,5-triazine, as well as the compounds having a reactive halogen, as described in U.S. Pat. Nos. 3,288,775 and 2,732,303, British Patent Nos. 974,723 and 1,167,207, etc., divinylsulfone, 5-acetyl-1,3-diacryloyl-hexahydro-1 3,5-triazine, etc. Other examples of hardening agents which can be used together with the hardening agents in this invention are compounds having a reactive olefin, as described in U.S. Pat. Nos. 3,635,718 and 3,232,763, British Patent No. 994,869, Japanese Patent Application (OPI) Nos. 41221/78, 57257/78, etc.; N-hydroxymethylphthalimide; N-methylol compounds, as described in U.S. Pat. Nos. 2,732,316 and 2,586,168; isocyanates, as described in U.S. Pat. No. 3,103,437; aziridine compounds, as described in U.S. Pat. Nos. 3,017,280, 2,983,611, etc.; the acid derivatives, as described in U.S. Pat. Nos. 2,725,294, 2,725,295, etc.; carbodiimide compounds, as described in U.S. Pat. 3,100,704, etc.; epoxy compounds, as described in U.S. Pat. No. 3,091,537, etc.; isooxazole compounds, as described in U.S. Pat. Nos. 3,321,313, 3,543,292, etc.; halogenocarboxyaldehydes, such as mucochloric acid, etc.; dioxane derivatives such as dihydroxydioxane, dichlorodioxane, etc.; dihydroquinoline compounds; compounds having phosphorus-halogen bond; N-sulfonyloxyimide compounds, N-acyloxyimino compounds; N-carbonyloxyimide compounds as described in Japanese Patent Application (OPI) No. 43353/81; 2-sulfonyloxypyridinium salts;

N-carbamoylpyridinium salts; etc. Furthermore, inorganic hardening agents such as chromium alum, zirconium sulfate, etc., may be used.

Moreover, in place of the above-described compounds, compounds in the form of precursors for hardening agent, such as alkali metal bisulfite-aldehyde addition products, metylol derivatives of hydantoin, primary aliphatic nitroalcohols, mesyloxyethylsulfonyl compounds, chloroethylsulfonyl compounds, etc., can be used with the hardening agents of this invention.

In the case of using the hardening agent for use in this invention with other known hardening agents, the proportion of the gardening agent of this invention may be desirably selected according to the purpose and effect thereof, but is preferably at least 50 mole %.

The hardening agent of this invention can be used together with a compound accelerating hardening gelatin. Examples of such a hardening accelerator include the nonprotonic solvents described in West German Patent Application (OLS) No. 2,417,586; the betaine type surface active agents described in Japanese Patent Application (OPI) No. 62045/82; tertiary amines and the salts thereof (as described, for example, in Japanese Patent Application (OPI) Nos. 1043/81, 9434/76, West German Patent Application (OLS) No. 2,138,305, British Patent Nos. 1,284,305, 1,269,983, etc.); various inorganic salts and polyhydric alcohols These hardening accelerators can be used together with the hardening agents of this invention and the above-described known hardening agents. For example, the polymer containing a sulfinic acid group described in Japanese Patent Application (OPI) No. 4141/81 may be used as a hardening accelerator for a system of the hardening agent of this invention and a vinylsulfonic hardening agent.

Gelatin to which the hardening agent of this invention is applied may be so-called alkali-treated (limed) gelatin, which is immersed in an alkaline bath before the extraction of gelatin, acid-treated gelatin, which is immersed in an acid bath, double immersed gelatin which is treated with alkali and acid, or an enzyme-treated gelatin as described in *Bull. Soc. Sci. Photo. Japan,* No. 16, page 30 (1966). Furthermore, the hardening agent of this invention can be applied to low molecular weight gelatin, i.e., gelatin which is partially hydrolyzed by heating in a water bath or by the action of a proteolytic enzyme.

Also, gelatin to which the hardening agent of this invention is applied may be, if necessary, partially replaced with colloidal albumin, casein, cellulose derivatives (e.g., carboxymethyl cellulose, hydroxyethyl cellulose, etc.), sugar derivatives (e.g., agar agar, sodium alginate, starch derivatives, etc.), and synthetic hydrophilic colloids (e.g., polyvinyl alcohol, poly-N-vinylpyrrolidone, polyacrylic acid copolymers, polyacrylamide, and derivatives or partially hydrolyzed products thereof) as well as gelatin derivatives modified by the treatment of an amino group, an imino group, a hydroxy group, or a carboxy group contained in the gelatin molecule as a functional group with a reagent having one group capable of reacting the group, or a gelatin graft polymer prepared by bonding gelatin to the molecular chain of another polymeric material.

Reagents for preparing the above-described derivatives include, for example, the isocyanates, acid chlorides, and acid anhydrides as described in U.S. Pat. No. 2,614,928; the acid anhydrides described in U.S. Pat. No. 3,118,766; the bromoacetic acids described in Japanese Patent Publication No. 5514/64; the phenylglycidyl ethers as described in Japanese Patent Publication No. 26845/67; the vinylsulfone compounds described in U.S. Pat. No. 3,132,945; the N-allylvinylsulfonamides described in British Patent No. 861,414; the maleimide compounds described in U.S. Pat. No. 3,186,846; the acrylonitriles described in U.S. Pat. No. 2,594,293; the polyalkylene oxides described in U.S. Pat. No. 3,312,553; the epoxy compounds described in Japanese Patent Publication No. 26845/67; the acid esters described in U.S. Pat. No. 2,763,639; and the alkanesultones described in British Patent No. 1,033,189.

Also, examples of the branched polymeric compound to be grafted to gelatin are described in U.S. Pat. Nos. 2,763,625, 2,831,767, 2,956,884, *Polymer Letters,* Vol. 5, p. 595 (1967), *Photo. Sci. Eng.,* Vol. 9, p. 148 (1965), *J. Polymer Sci.,* A-1, Vol. 9, p. 3199 (1971), etc.; also, polymers or copolymers of acrylic acid, methacrylic acid, or the derivatives thereof, such as the esters, amides, nitriles, etc., or vinyl monomers such as styrene, etc., can be used as such a polymeric material. Hydrophilic vinyl polymers or copolymers having a compatibility with gelatin to some extent, such as the polymers or copolymers of acrylic acid, acrylamide, methacrylamide, hydroxyalkyl acrylate, hydroxyalkyl methacrylate, etc., are preferably used.

In the case of using the hardening agent of this invention for photographic materials, the photographic silver halide emulsion layers or other layers may contain synthetic polymers such as a latex form water-dispersible vinyl polymer, and, in particular, a polymer capable of increasing the dimensional stability of the photographic materials, whether used singly or as a combination, or with a hydrophilic water-permeable colloid.

In the case of using the gelatin hardening agent of this invention for photographic materials, the hardening agent may be also used together with a matting agent. The matting agent used in this case is fine particles of a water-insoluble organic or inorganic compound having a mean particle size of from 0.2 to 10 μm, and preferably from 0.3 to 5 μm.

For the color photographic material of this invention, the 5-pyrazolone type 2-equivalent magenta couplers may be used singly or as a mixture thereof. Also, the photographic material may further contain a cyan coupler and a 2-equivalent yellow coupler.

Cyan couplers that can be used include phenolic couplers, naphtholic couplers, etc. 2-equivalent yellow couplers include pivaloylacetanilide 2-equivalent couplers, benzoylacetanilide 2-equivalent couplers, malondianilide 2-equivalent couplers, etc.

Examples of such cyan couplers are described, for instance, in Japanese Patent Publication Nos. 34733/78, 37822/79, 37823/79, 6539/81, 3934/82, Japanese Patent Application (OPI) Nos. 14736/79, 48237/79, 66129/79, 65957/80, 1958/81, 12643/81, 27147/81, 116030/81, 126830/81, 73050/80, 80045/81, 104333/81, 204544/82, 204545/82, 200039/82, 42045/83, 98731/83, 105229/83, 118643/83, 187928/83, 189154/83, 211756/83, 31953/84, 40643/84, 35731/85, 95346/83, U.S. Pat. Nos. 4,072,525, 4,083,721, 4,146,396, 4,228,233, 4,254,212, 4,264,722, 4,333,999, etc.

Examples of the 2-equivalent yellow couplers are described, for instance, in Japanese Patent Publication Nos. 13576/74, 10783/76, 26038/76, 102636/76, 25733/76, 7579/80, 13023/80, 5988/81, 7222/81, 45134/81, 45135/81, 44420/81, 37858/82, 37859/82, 10739/83, Japanese Patent Application (OPI) Nos. 34232/75, 21827/76, 75521/76, 20023/77, 38576/80, 161239/80, 87041/81, 95237/81, 153343/81, 161543/81, 155538/82, 125039/83, 139138/83, U.S. Pat. Nos. 2,329,587, 3,227,554, 3,408,194, 3,415,652, 3,542,840, 3,644,498, 3,933,501, 3,990,896, 4,032,347, 4,049,458, 4,133,958, 4,201,584, 4,115,121, 4,157,919, 4,206,278, 4,401,752, 4,404,274, U.S. Pat. No. Re. 30,211, West German Patent Application (OLS) No. 3,107,137A1, British Patent No. 2,011,398, Japanese Patent Application (OPI) Nos. 214854/84, 228640/84, *Research Disclosure,* RD No. 18053, (April, 1979), etc.

These 5-pyrazolone magenta couplers, cyan couplers, and yellow couplers may be couplers forming dyes having a proper diffusibility by development as described in, for example, U.S. Pat. No. 4,420,556.

The color photographic materials of this invention may further contain so-called DIR (development inhibitor releasing) couplers, i.e., the couplers capable of releasing a development inhibitor with the progress of development.

Examples of the DIR couplers include couplers releasing a heterocyclic mercapto series development inhibitor described in U.S. Pat. No. 3,227,554; the couplers releasing a benzotriazole derivative as a development inhibitor described in Japanese Patent Publication No. 9942/83; the so-called non-coloring DIR couplers described in Japanese Patent Publication No. 16141/76; the couplers releasing a nitrogen-containing heterocyclic development inhibitor with the decomposition of methylol after release, as described in Japanese Patent Application (OPI) No. 90932/77; the couplers releasing a development inhibitor with an intramolecular nucleophilic reaction after releas, as described in U.S. Pat. No. 4,248,962; the couplers releasing a development inhibitor by electron transfer through a covalent system after release, as described in Japanese Patent Application (OPI) Nos. 114946/81, 56837/82, 154234/82, 188035/82, 98728/83, 209736/83, 209737/83, 209738/83, 209740/83, etc.; the couplers releasing a diffusible development inhibitor having a development inhibiting faculty which is inactivated in developer described in Japanese Patent Application (OPI) Nos. 151944/82, 217932/83, etc.; and the couplers which release a reactive compound and form a development inhibitor by the reaction in photographic emulsion layer during development or inactivate a development inhibitor described in Japanese Patent Application Nos. 38263/84 and 39653/84 (which are corresponding to U.S. patent application Ser. No. 707,103, filed on Feb. 28, 1985, and West German Patent Application No. P 35 06 805.1, filed on Feb. 27, 1985), etc.

Preferred examples of the above-described DIR couplers which are combined with the hardening agents of this invention are the developer inactivating type couplers described in Japanese Patent Application (OPI) No. 151944/82; the timing type couplers described in U.S. Pat. No. 4,248,962 and Japanese Patent Application (OPI) No. 154234/82; and the reaction type couplers described in Japanese Patent Application No. 39653/84 (corresponding to U.S. patent application Ser. No. 707,103, filed on Feb. 28, 1985, and West German Patent Application No. P 35 06 805.1, filed on Feb. 27, 1985). Particularly preferred couplers are the developer inactivating type DIR couplers described in Japanese Patent Application (OPI) No. 151944/82, and the reaction type DIR couplers described in Japanese Patent Application No. 39653/84 (corresponding to U.S. patent application Ser. No. 707,103, filed on Feb. 28, 1985, and West German Patent Application No. P 35 06 805.1, filed on Feb. 27, 1985), etc.

Also, in the above-described yellow couplers, magenta couplers, and cyan couplers, moieties other than the coupling moieties thereof may be present in the form of compounds having an ethylenically polymerizable group singly or as a mixture thereof, or, if desired, may be a so-called polymer coupler having a repeating unit of a non-coloring monomer.

In the photographic materials of this invention, couplers can be introduced in silver halide emulsion layers by a known method, such as that described, for example, in U.S. Pat. No. 2,322,027, etc.

For example, the coupler is dissolved in a high boiling organic solvent such as phthalic acid alkyl ester (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, diethyl azerate, etc.), trimesic acid esters (e.g., tributyl trimesate, etc.), etc., or a low boiling organic solvent having a boiling point of from about 30° to 150° C., such as a lower alkyl acetate (e.g., ethyl acetate, butyl acetate, etc.), ethyl propionate, secbutyl alcohol, methyl isobutyl ketone, $\beta$-ethoxyethyl acetate, methyl cellosolve acetate, etc., and then dispersed in an aqueous hydrophilic colloid solution. The above-described high boiling solvents and low boiling solvents may be used as a mixture thereof.

Also, a dispersion method by a polymer described in Japanese Patent Publication No. 39853/76 and Japanese Patent Application (OPI) No. 59943/76 can be used.

In the case of using the polymer coupler, the coupler may be produced by an emulsion polymerization or a solution polymerization. In the case of emulsion polymerization, the emulsion polymerization product may be added as it is to a silver halide emulsion. In the case of a solution polymerization, the solution polymerization product may be removed from the reaction system, re-dissolved in an organic solvent, and then added to a silver halide emulsion.

The amount of the coupler used in this invention may be properly selected according to the particular intended use, but is usually from $2\times10^{-3}$ mole to 1 mole, and preferably from $5\times10^{-3}$ to 0.5 mole, per mole of silver halide in the silver halide emulsion layer.

For the silver halide photographic materials of this invention, silver bromide, silver iodobromide, silver iodochlorobromide, silver chlorobromide, or silver chloride can be used as the silver halide.

There is no particular restriction on the mean grain size (the size is indicated by the diameter of grains when the silver halide grains are spherical or similar to spherical grains, or indicated by the mean value based on the projected areas with the length of edges as the grain size when the silver halide grains are cubic grains) of silver halide grains of the photographic silver halide emulsion but the mean grain size is preferably less than 3 $\mu$m.

The grain size distribution may be narrow or broad.

The silver halide grains in the silver halide photographic emulsion for use in this invention may have regular crystal form such as a cube or an octahedron, or may have an irregular crystal form such as a spherical form or a tabular form, or may be a composite form of these crystal forms. The silver halide grains may be composed of a mixture of grains having various crystal forms.

Moreover, a silver halide emulsion in which tabular silver halide grains having a diameter more than 5 times larger than the thickness (i.e., an Aspect Ratio of 5 or more) thereof occupies more than 50% of the total surface area can be used in this invention.

The silver halide grains for use in this invention may have different phases between the inside thereof and the surface layer. Also, the silver halide grains may be grains mainly forming latent images on the surface thereof or grains mainly forming latent images in the inside thereof.

The silver halide photographic emulsions for use in this invention can be prepared by the methods described in P. Glafkides, *Chimie et Physique Photographique,* (published by Paul Montel Co., 1967), G. F. Duffin, *Photographic Emulsion Chemistry,* (published by The Focal Press, 1966), V. L. Zelikman et al., *Making and Coating Photographic Emulsion,* (published by The Focal Press, 1964), etc. That is, the silver halide emulsion may be prepared by an acid method, a neutralization method, an ammonia method, etc., and the system of reacting a soluble silver salt and a soluble halide may be a one-side mixing method, a simultaneous mixing method, or a combination thereof.

Also, a so-called reverse mixing method for forming silver halide emulsion in the presence of an excessive silver ion can be employed.

As one of the types of simultaneous mixing, a controlled double jet method for maintaining pAg in the liquid phase for forming silver halide at a constant value can be used. According to the method, a silver halide emulsion wherein the crystal form of the silver halide grains is regular and the grain sizes thereof are almost uniform can be obtained.

Two or more kinds of silver halide emulsions separately formed may be used as a mixture thereof.

The formation of the silver halide grains or the physical ripening thereof may be performed in the presence of a cadmium salt, a zinc salt, a lead salt, a thallium salt, an iridium salt or a complex salt thereof, a rhodium salt or a complex salt thereof, or an iron salt or a complex salt thereof.

After forming the precipitation of a silver halide or after physical ripening of a silver halide emulsion, soluble salts formed are usually removed. For removing the salts, a noodle washing method for washing the emulsion with water after gelling the gelatin of the emulsion or a flocculation method utilizing an inorganic salt composed of a polyvalent anion can be used.

The silver halide emulsions for use in this invention are usually chemically sensitized using a method as described, for example, in H. Frieser, *Die Grundlagen der Photographischen Prozesse mit Silberhalogeniden* (published by Akademische Verlagsgesellschaft, 1968), pages 675–734.

Such chemical sensitization methods include a sulfur sensitization method using active gelatin or a sulfur-containing compound capable of reacting with silver (e.g., a thiosulfate, a thiourea, a mercapto compound, a rhodanine, etc.); a reduction sensitizing method using a reducing material (e.g., a stannous salt, an amine, a hydrazine derivative, formamidinesulfinic acid, a silane compound, etc.); a noble metal sensitizing method using a noble metal compound (e.g., a gold complex salt and a complex salt of a metal belonging to the group VIII of the Periodical Table, such as Pt, Ir, Pd, etc.). They can be applied individually or as a combination thereof.

The silver halide photographic emulsions for use in this invention may contain various compounds for preventing the occurrence of fog or stabilizing the photographic performance of the photographic materials during the production, storage, or photographic processing of the photographic materials. Examples of these compounds known as a fog preventing agent or a stabilizer include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles benzotriazoles, nitrobenzotriazoles, mercaptotetrazoles (in particular, 1-phenyl-5-mercaptotetrazole), etc.; mercaptopyrimidines; mercaptotriazines; thioketo compounds such as oxazolinethione; azaindenes such as triazaindenes, tetraazaindenes (in particular, 4-hydroxy-substituted (1,3,3a,7)tetraazaindenes), pentaazaindenes, etc.; benzenethiosulfonic acid, benzenesulfinic acid, benzenesulfonic acid amide, etc.

The color photographic materials of this invention may further contain in the silver halide photographic emulsion layers or other hydrophilic colloid layers various surface active agents for various purposes, such as the improvement of coating property of these layers, the improvement of antistatic property, the improvement of lubricity, the improvement of dispersibility, the prevention of adhesion, and improvement of various photographic properties (e.g., the acceleration of development, the improvement of contrast and sensitivity, etc.).

Also, the photographic materials of this invention may further contain in the silver halide photographic emulsion layers polyalkylene oxide or the derivatives thereof, such as the ethers, esters, amines, etc., thioether compounds, thiomorpholines, quaternary ammonium salts, urethane derivatives, urea derivatives, imidazole derivatives, 3-pyrazolidines, etc., for the purposes of increasing sensitivity, increasing contrast, or accelerating development.

The silver halide photographic emulsions containing the hardening agent of this invention may be spectrally sensitized by methine dyes, etc. As such dyes, there are cyanine dyes, merocyanine dyes, complex cyanine dyes, complex merocyanine dyes, holopolar cyanine dyes, hemicyanine dyes, styryl dyes, and hemioxonol dyes. Particularly useful dyes include cyanine dyes, merocyanine dyes, and complex merocyanine dyes. Any nuclei usually utilized for cyanine dyes as basic heterocyclic nuclei can be applied for these dyes. Examples of these nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing aliphatic hydrocarbon rings to the aforesaid nuclei; the nuclei formed by fusing aromatic hydrocarbon rings to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may have substituent(s) on carbon atoms thereof.

The merocyanine dyes or complex merocyanine dyes can include, as a nucleus having a ketomethylene structure, 5- or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc.

These sensitizing dyes may be used solely or as a combination thereof. A combination of sensitizing dyes is frequently used for the purpose of supersensitization.

The photographic emulsion layer for use in this invention may further contain a dye which does not have a spectral sensitizing action by itself or a material which does not substantially absorb visible light, together with the sensitizing dye or dyes. Examples of these compounds are aminostyryl compounds substituted by a nitrogen-containing heterocyclic ring group (e.g., as described in U.S. Pat. Nos. 2,933,390 and 3,635,721), aromatic organic acid-formaldehyde condensation products (as described, e.g., in U.S. Pat. No. 3,743,510), cadmium salts, azaindene compounds, etc.

The color photographic material of this invention usually has on a support at least one red-sensitive silver halide emulsion layer, at least one green-sensitive silver halide emulsion layer and at least one blue-sensitive silver halide emulsion layer. The order of disposition of the emulsion layers can be optionally selected according to the intended purpose.

Usually, the red-sensitive emulsion layer contains a cyan forming coupler, the green-sensitive emulsion layer contains a magenta forming coupler, and the blue-sensitive emulsion layer contains a yellow forming coupler. However, other combinations may be employed, if desired.

When the color photographic materials of this invention contain in the hydrophilic colloid layers dyes or ultraviolet absorbents, these additives may be mordanted by a cationic polymer, etc.

The photographic materials of this invention may further contain hydroquinone derivatives, aminophenol derivatives, gallic acid derivatives, ascorbic acid derivatives, etc., as color fogging preventing agents.

The photographic materials of this invention may contain in the hydrophilic colloid layers ultraviolet absorbers such as, for example, benzotriazole compounds substituted with an aryl group (described, e.g., in U.S. Pat. No. 3,533,794), 4-thiazolidone compounds (described, for example, in U.S. Pat. Nos. 3,314,794, 3,352,681, etc.), benzophenone compounds (described, for example, in Japanese Patent Application (OPI) No. 2784/71), cinnamic acid ester compounds (described, for example, in U.S. Pat. Nos. 3,705,805 and 3,707,375), butadiene compounds (described, for example, in U.S. Pat. No. 4,045,229), and benzoxidole compounds (described, for example, in U.S. Pat. No. 3,700,455). Furthermore, ultraviolet absorptive couplers (e.g., α-naphtholic cyan dye forming couplers) or ultraviolet absorptive polymers may be used. These ultraviolet absorbents may be mordanted to specific layers of the photographic materials.

The photographic materials of this invention may further contain in the hydrophilic colloid layers water-soluble dyes as filter dyes, anti-irradiation dyes, etc. Such dyes include oxonol dyes, hemioxonol dyes, styryl dyes, merocyanine dyes, cyanine dyes and azo dyes. Among these dyes, oxonol dyes, hemioxonol dyes and merocyanine dyes are advantageous.

For the photographic materials of this invention, the following known fading preventing agents or color image stabilizers can be used singly or as a combination thereof. Examples of these fading preventing agents are hydroquinone derivatives described, for example, in Japanese Patent Application (OPI) No. 10539/84, gallic acid derivatives, p-alkoxyphenols, p-oxyphenol derivatives, and bisphenols.

The silver halide photographic emulsions for use in this invention are coated on plane materials which do not cause severe dimensional change during photographic processing, for example, hard supports such as glass sheet, metal foils, porcelains, etc., or flexible supports.

Specific examples of flexible supports include cellulose acetate films, polyethylene terephthalate films, polycarbonate films, laminates of these films, baryta-coated papers, papers coated or laminated with an α-olefin polymer, and in particular a polymer of α-olefin having 2 to 10 carbon atoms, such as polyethylene, polypropylene, etc.

Known methods and known processing liquids can be applied for photographic processing of the color photographic materials of this invention, as described, for example, in *Research Disclosure*, No. 176, pages 28 to 30 (December, 1978). The processing temperature is usually from 18° C. to 50° C., but may be lower than 18° C. or higher than 50° C., if desired.

For fixing the photographic materials of this invention, a conventional fixing solution can be used. As a fixing agent, a thiosulfate, a thiocyanate, as well as organic sulfur compounds which are known to have an effect as fixing agent can be used. The fixing solution may further contain a water-soluble aluminum salt as a hardening agent.

A color developer which is used for developing the color photographic materials of this invention is generally composed of an alkaline aqueous solution containing a color developing agent. As the color developing agent, known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.), etc., can be used.

Other examples of the color developing agents which can be used for developing the photographic materials of the invention are described, for example, in L. F. A. Mason, *Photographic Processing Chemistry*, pages 226–229 (published by The Focal Press, 1966), U.S. Pat. Nos. 2,193,015 and 2,592,364, Japanese Patent Application (OPI) No. 64933/73, etc.

The color developer may further contain a pH buffer such as a sulfite, carbonate, borate, and phosphate of an alkali metal or an antifoggant such as a bromide, an iodide and various organic antifoggants. Also, the color developer may, if desired, contain a preservative such as hydroxylamine, etc., a water softener, an organic solvent such as benzyl alcohol, diethylene glycol, etc., a development accelerator such as polyethylene glycol, a quaternary ammonium salt, an amine, etc., competing couplers, a fogging agent such as sodium borohydride, etc., an auxiliary developing agent such as 1-phenyl-3-pyrazolidone, a tackifier, a polycarboxylic acid series chelating agent, an antioxidant, etc.

The photographic emulsion layers are usually bleached after color development. The bleach process may be performed simultaneously with the fix process or may be performed separately. As the bleaching agent, compounds of polyvalent metals such as iron (III), cobalt (III), chromium (VI), copper (II), etc., peroxides, quinones, nitroso compounds, etc., can be used.

Examples of the bleaching agent include ferricyanides; dichromates; organic complex salts of iron (III) or cobalt (III), for example, complex salts of organic acids such as aminopolycarboxylic acids (e.g., ethylenediaminetetraacetic acid, nitrilotriacetic acid, 1,3-diamino-2-propanol tetraacetic acid, etc.), citric acid, tartaric acid, malic acid, etc.; persulfates; permanganates; nitrosophenol, etc. In these materials, potassium ferricyanide, sodium ethylenediaminetetraacetate iron (III), and ammonium ethylenediaminetetraacetate iron (III) are particularly advantageous. The ethylenediaminetetraacetic acid iron (III) complex salts are useful for both a bleach solution and a blix solution.

The invention is further illustrated by the following examples.

EXAMPLE 1

Sample 101 (Comparison Sample):

A monocolor layer color photographic material (Sample 101) was prepared by forming layers having the following compositions on a cellulose triacetate film support:

A First Layer: Green-Sensitive Emulsion Layer:

A layer containing a silver iodobromide emulsion (mean grain size of 0.7 μm, uniform distribution of iodine in the grains, silver iodide content of 3 mole %) at a silver coverage of 0.3 g/m$^2$, a silver iodobromide emulsion (mean grain size of 0.3 μm, uniform distribution of iodine in the grains, silver iodide content of 3 mole %) at a silver coverage of 0.1 g/m$^2$, 0.8 g/m$^2$ of gelatin, a sensitizing dye (O-1) in an amount of $5\times10^{-4}$ mole per mole of silver, a sensitizing dye (O-2) in an amount of $2\times10^{-4}$ mole per mole of silver, 0.3 g/m$^2$ of a coupler (Cp-1), and 0.2 g/m$^2$ of OIL-1.

A Second Layer: First Protective Layer:

A layer containing fine silver halide grains (silver bromide having a mean grain size of 0.07 μm) at a silver coverage of 0.5 g/m$^2$, 1 g/m$^2$ of gelatin, 0.2 g/m$^2$ of polymethyl methacrylate particles (diameter of about 1.5 μm), and 0.4 g/m$^2$ of a hardening agent (HA-1).

Sample 102 (Comparison Sample):

Sample 102 was prepared by replacing the hardening agent (HA-1) in Sample 101 with 4.5 times as much (on a molar basis) of hardening agent H-3.

Sample 103 (Comparison Sample):

Sample 103 was prepared by replacing the magenta coupler (Cp-1) in Sample 101 with 0.6 times as much (on a molar basis) of M-31.

Sample 104 (Sample of the Invention):

Sample 104 was prepared by replacing the hardening agent (HA-1) in Sample 101 with 4.5 times as much (on a molar basis) of hardening agent (H-3) and replacing the magenta coupler Cp-1 in Sample 101 with 0.6 times as much (on a molar basis) of magenta coupler M-31.

Each of Samples 101 to 104 thus prepared was subjected to wedge exposure by white light of 4,800° K., processed, and then subjected to sensitometry by means of a densitometer using a Status M filter (of which characteristics are described in ISO 5800 (1979)).

The results thus obtained are shown in Table 1 below.

In addition, Samples 105 to 109 of this invention were also prepared by replacing the hardening agent H-2 in Sample 104 with each of the hardening agents H-3 to H-7, and substantially the same results were obtained for these additional samples.

TABLE 1

| Sample | Hardening Agent | Amount (mole ratio) | Magenta Coupler | Amount (mole ratio) | Post-Hardening Ratio* | Reduction of Dm by the Change from HA-1 to H-3 (%) |
|---|---|---|---|---|---|---|
| 101 (Comparison) | HA-1 | 1 | Cp-1 | 1 | 0.25 | 10 |
| 102 (Comparison) | H-3 | 4.5 | Cp-1 | 1 | 0 | |
| 103 (Comparison) | HA-1 | 1 | M-31 | 0.6 | 0.25 | 0 |
| 104 (Sample of the Invention | H-3 | 4.5 | M-31 | 0.6 | 0 | |

*The post hardening ratio is the value given by the following equation about the sample stored under the conditions of 25° C. and 55% in relative humidity.

$$\text{Post-hardening ratio} = \frac{(A) - (B)}{(C)}$$

(A): Thickness of swelled layer (after 48 hours storage)

(B): Thickness of swelled layer (after 168 hours storage)

(C): Dry thickness of the layer

Structural formulae of the compounds used as described above are shown below.

O-1

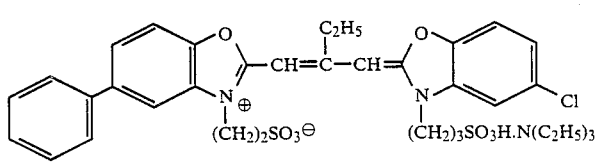

-continued

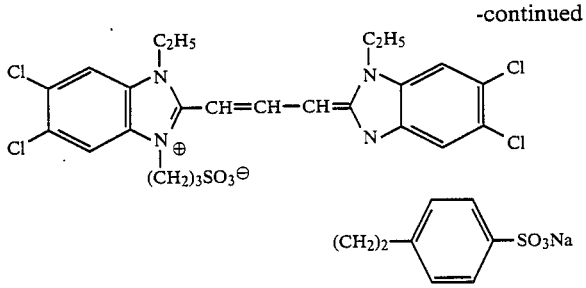

O-2

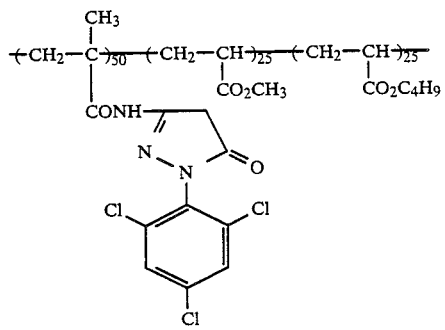

Cp-1

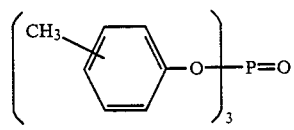

Oil-1

$(CH_2{=}CHSO_2CH_2CONHCH_2)_2HA$-1

EXAMPLE 2

Sample 201 (Comparison Sample):

A multilayer color photographic material (Sample 201) was prepared by forming on a cellulose triacetate film support the layers having the following compositions.

A First Layer: Antihalation Layer:

A layer containing black colloidal silver at a silver coverage of 0.2 g/m$^2$, 1.5 g/m$^2$ of gelatin, 0.1 g/m$^2$ of an ultraviolet absorbent (UV-1), 0.2 g/m$^2$ of an ultraviolet absorbent (UV-2), 0.01 g/m$^2$ of OIL-1 (an oil for dispersing UV-1 and UV-2), and 0.01 g/m$^2$ of OIL-2 (an oil for dispersing UV-1 and UV-2).

A Second Layer: Interlayer:

A layer containing fine silver halide grains (silver bromide having a mean grain size of 0.07 μm) at a silver coverage of 0.15 g/m$^2$, 1.0 g/m$^2$ of gelatin, 0.1 g/m$^2$ of a colored coupler (Cp-12), 0.01 g/m$^2$ of a colored coupler (Cp-2), and 0.1 g/m$^2$ of OIL-1.

A Third Layer: First Red-Sensitive Emulsion Layer:

A layer containing a silver iodobromide emulsion (mean grain size of 0.7 μm, uniform distribution of iodine in the grains, silver iodide content of 3 mole %) at a silver coverage of 0.5 g/m$^2$, a silver iodobromide emulsion (mean grain size of 0.3 μm, uniform distribution of iodine in the grains, silver iodide content of 3 mole %) at a silver coverage of 0.2 g/m$^2$, 2.5 g/m$^2$ of gelatin, a sensitizing dye (P-1) in an amount of $4.5\times10^{-4}$ mole per mole of silver, a sensitizing dye (P-2) in an amount of $1.5\times10^{-4}$ mole per mole of silver, 0.5 g/m$^2$ of a coupler (Cp-3), 0.02 g/m$^2$ of a DIR coupler (Cp-4), 0.11 g/m$^2$ of a colored coupler (Cp-2), 0.3 g/m$^2$ of OIL-1, and 0.3 g/m$^2$ of OIL-2.

A Fourth Layer: Second Red-Sensitive Emulsion Layer

A layer containing a silver iodobromide emulsion (mean grain size of 1.0 μm, grains having non-uniform distribution of iodide in and between grains, formed by a single jet method, silver iodide content of 10 mole %) at a silver coverage of 1.2 g/m$^2$, 1.5 g/m$^2$ of gelatin, a sensitizing dye (P-1) in an amount of $3\times10^{-4}$ mole per mole of silver, a sensitizing dye (P-2) in an amount of $1\times10^{-4}$ mole per mole of silver, 0.2 g/m$^2$ of a coupler (Cp-3), 0.04 g/m$^2$ of a colored coupler (Cp-2), 0.12 g/m$^2$ of OIL-1, and 0.12 g/m$^2$ of OIL-2.

A Fifth Layer: Third Red-Sensitive Emulsion Layer:

A layer containing a silver iodobromide emulsion (mean grain size of 2.0 μm, spherical grains formed by an ammonia method, silver iodide content of 7 mole %) at a silver coverage of 2 g/m$^2$, 2 g/m$^2$ of gelatin, a sensitizing dye (P-1) in an amount of $2\times10^{-4}$ mole per mole of silver, a sensitizing dye (P-2) in an amount of $0.6\times10^{-4}$ mole per mole of silver, 0.17 g/m$^2$ of a coupler (Cp-10), 0.04 g/m$^2$ of a colored coupler (Cp-2), 0.12 g/m$^2$ of OIL-1, and 0.12 g/m$^2$ of OIL-2.

A Sixth Layer: Interlayer:

A layer containing 1.0 g/m$^2$ of gelatin, 0.2 g/m$^2$ of a color mixing preventing agent (Cp-5), 0.1 g/m$^2$ of OIL-1, and 0.1 g/m$^2$ of OIL-2.

A Seventh Layer: First Green-Sensitive Emulsion Layer:

A layer containing a silver iodobromide emulsion (mean grain size of 0.7 μm, uniform distribution of iodide in the grains, silver iodide content of 3 mole %) at a silver coverage of 0.3 g/m$^2$, a silver iodobromide emulsion (mean grain size of 0.3 μm, uniform distribution of iodide in the grains, silver iodide content of 3 mole %) at a silver coverage of 0.1 g/m$^2$, 0.8 g/m$^2$ of gelatin, a sensitizing dye (O-1) in an amount of $5\times10^{-4}$ mole per mole of silver, a sensitizing dye (O-2) in an amount of $2\times10^{-4}$ mole per mole of silver, 0.27 g/m$^2$ of a coupler (Cp-1), 0.05 g/m$^2$ of a DIR coupler (Cp-6), 0.06 g/m$^2$ of a colored coupler (Cp-7), and 0.2 g/m$^2$ of OIL-1.

An Eighth Layer: Second Green-Sensitive Emulsion Layer:

A layer containing a silver iodobromide emulsion (mean grain size of 1.0 μm, grains having non-uniform distribution of iodide in and between the grains, formed by a single jet method, silver iodide content of 10 mole %) at a silver coverage of 1 g/m$^2$, 1 g/m$^2$ of gelatin, a sensitizing dye (O-1) in an amount of $3.5\times10^{-4}$ mole per mole of silver, a sensitizing dye (O-2) in an amount of $1.4\times10^{-4}$ mole per mole of silver, 0.22 g/m$^2$ of a coupler (Cp-1), 0.05 g/m$^2$ of a colored coupler (Cp-7), and 0.15 g/m$^2$ of OIL-1.

A Ninth Layer: Third Green-Sensitive Emulsion Layer:

A layer containing a silver iodobromide emulsion (mean grain size of 2.0 μm, spherical grains formed by an ammonia method, silver iodide content of 7 mole %) at a silver coverage of 2 g/m$^2$, 2 g/m$^2$ of gelatin, a sensitizing dye (O-1) in an amount of $2\times10^{-4}$ mole per mole of silver, a sensitizing dye (O-2) in an amount of $0.8\times10^{-4}$ mole per mole of silver, 0.14 g/m$^2$ of a coupler (Cp-1), 0.03 g/m$^2$ of a colored coupler (Cp-7), and 0.2 g/m$^2$ of OIL-1.

A Tenth Layer: Yellow Filter Layer:

A layer containing yellow colloidal silver at a silver coverage of 0.04 g/m$^2$, 1 g/m$^2$ of gelatin, 0.2 g/m$^2$ of a color mixing preventing agent (Cp-5), 0.1 g/m$^2$ of OIL-1, and 0.1 g/m$^2$ of OIL-2.

An Eleventh Layer: First Blue-Sensitive Emulsion Layer:

A layer containing a silver iodobromide emulsion (mean grain size of 0.7 μm, uniform distirbution of iodide in the grains, silver iodide content of 3 mole %) at a silver coverage of 0.2 g/m$^2$, a silver iodobromide emulsion (mean grain size of 0.3 μm, uniform distribution of iodide in the grains, silver iodide content of 3 mole %) at a silver coverage of 0.7 g/m$^2$, 1.2 g/m$^2$ of gelatin, a sensitizing dye (O-3) in an amount of $3\times10^{-4}$ mole per mole of silver, 0.7 g/m$^2$ of a coupler (Cp-8), 0.03 g/m$^2$ of a DIR coupler (Cp-11), and 0.5 g/m$^2$ of OIL-1.

A Twelfth Layer: Second Blue-Sensitive Emulsion Layer:

A layer containing a silver iodobromide emulsion (mean grain size of 1.0 μm, grains having nonuniform distribution of iodide in and between the grains, formed by a single jet method, silver iodide content of 10 mole %) at a silver coverage of 0.3 g/m$^2$, 0.4 g/m$^2$ of gelatin, a sensitizing dye (O-3) in an amount of $2\times10^{-4}$ mole per mole of silver, 0.3 g/m$^2$ of a coupler (Cp-8), and 0.2 g/m$^2$ of OIL-1.

A Thirteenth Layer: Third Blue-Sensitive Emulsion Layer:

A layer containing a silver iodobromide emulsion (mean grain size of 2.0 μm, spherical grains formed by an ammonia method, silver iodide content of 7 mole %) at a silver coverage of 1 g/m$^2$, 0.7 g/m$^2$ of gelatin, a sensitizing dye (O-3) in an amount of $1.5\times10^{-4}$ mole per mole of silver, 0.2 g/m$^2$ of a coupler (Cp-8), and 0.14 g/m$^2$ of OIL-1.

A Fourteenth Layer: First Protective Layer:

A layer containing 1.5 g/m$^2$ of gelatin, 0.1 g/m$^2$ of an ultraviolet absorbent (UV-1), 0.2 g/m$^2$ of an ultraviolet absorbent (UV-2), 0.01 g/m$^2$ of OIL-1 (oil for dispersing UV-1 and UV-2), and 0.01 g/m$^2$ of OIL-2 (oil for dispersing UV-1 and UV-2).

A Fifteenth Layer: Second Protective Layer:

A layer containing fine silver halide grains (silver bromide having a mean grain size of 0.07 μm) at a silver coverage of 0.5 g/m$^2$, 1 g/m$^2$ of gelatin, 0.2 g/m$^2$ of polymethyl methacrylate particles (diameter: about 1.5 μm), 0.02 g/m$^2$ of a charge control agent (W-1), 0.4 g/m$^2$ of a hardening agent (HA-1), and 1 g/m$^2$ of a formaldehyde scavenger (S-1).

Sample 202:

Sample 202 was prepared in the same manner as Sample 201, except for replacing the hardening agent in the fifteenth layer of Sample 201 with 1.1 g/m$^2$ of a hardening agent H-19.

Sample 203:

Sample 203 was prepared by applying the following changes to Sample 201:

(1) The coupler Cp-1 in the seventh to ninth layers was replaced with 0.7 times by weight of M-31.

(2) The coating amount of the emulsions in the seventh to ninth layers was reduced to 0.6 times by weight and the hardening agent in the fifteenth layer with 1.1 g/m$^2$ of a hardening agent H-19.

Each of Samples 201 to 203 thus prepared was stored for 7 days at 25° C. and 55% relative humidity (RH), subjected to a wedge exposure by white light of 4,800° K., and then processed. Then, the sample thus processed was subjected to sensitometry testing by means of a densitometer using a Status M filter. The results thus obtained are shown in Table 2.

TABLE 2

| Sample | $G_{1.0}$ |
|---|---|
| 201 (Comparison) | 0.65 |
| 202 (Comparison) | 0.52 |
| 203 (Sample of the Invention) | 0.64 |

In the table, $\overline{G}_{1.0}$ is defined as follows:

$G_{1.0}=D_2-D_1$ $D_1=\text{fog}+0.2$ $E_1$ is an exposure amount (log value) which is required to obtain $D_1$ based on the characteristic curve of the green-sensitive layer.

$E_2=E_1+1.0$ $D_2$ is a density obtained by exposure amount $E_2$ based on the same characteristic curve.

From the results, it is clear that Sample 203 of this invention does not show softened gradation caused by poor coloring of the couplers in the green-sensitive emulsion layer, while considerably softened gradation is observed in Sample 202 (Comparison) which contains a combination of quick hardener H-19 and 4-equivalent 5-pyrazolone coupler Cp-1. On the other hand, Sample 201 has no advantage on quick hardening.

Structural formulae of the compounds used in the foregoing examples are shown below.

UV-1
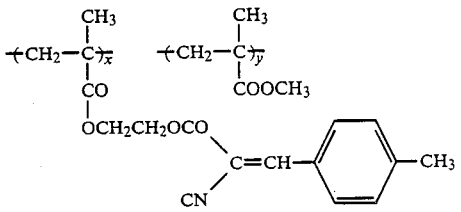
x/y = 7/3 (weight ratio)
UV-2
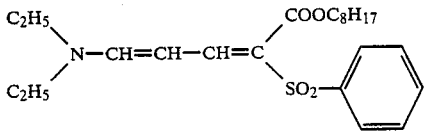
OIL-2
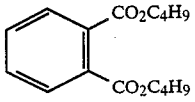
Cp-2
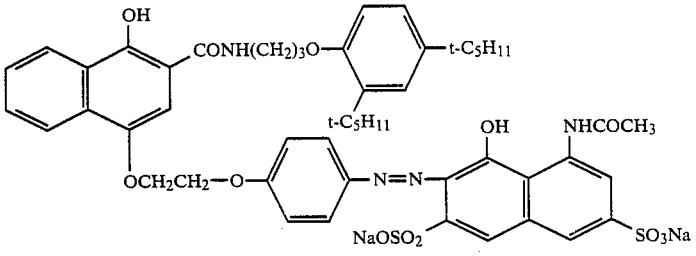
Cp-3
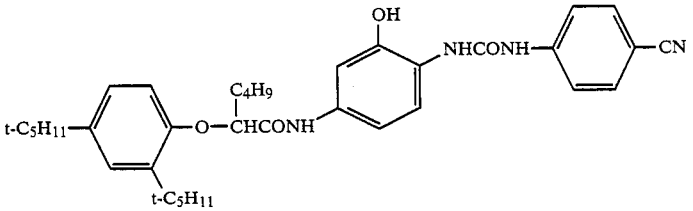
Cp-4
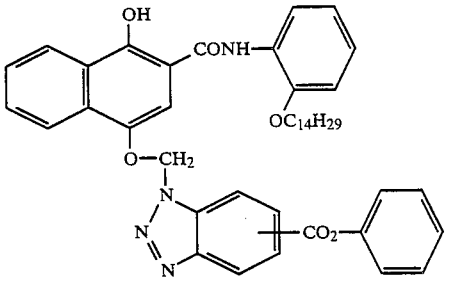
Cp-5
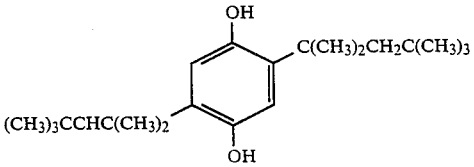

-continued
Cp-6
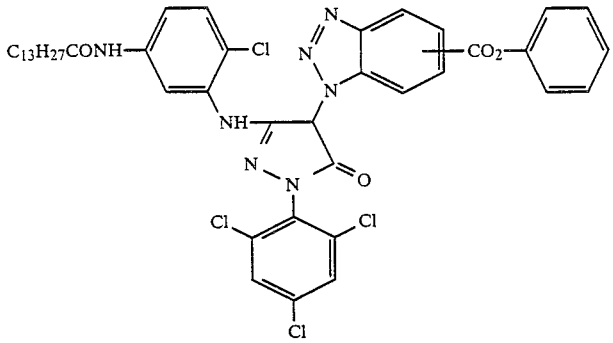
Cp-7
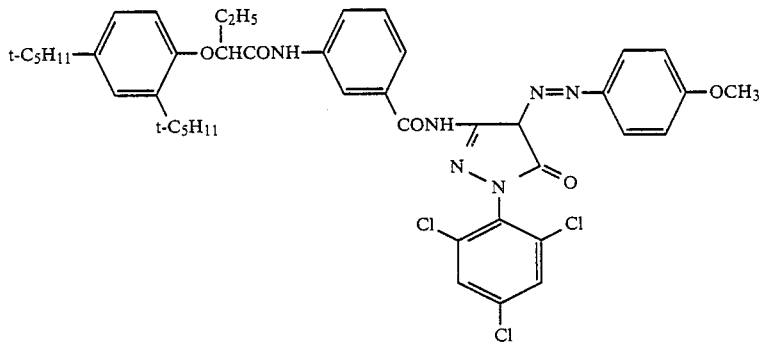
Cp-8
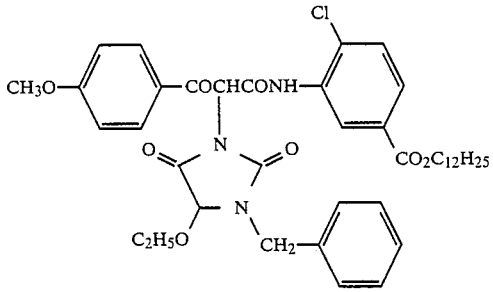
Cp-10
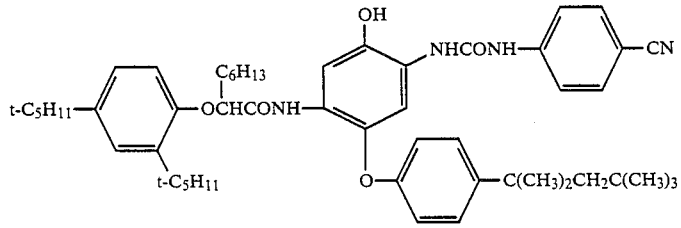
Cp-11
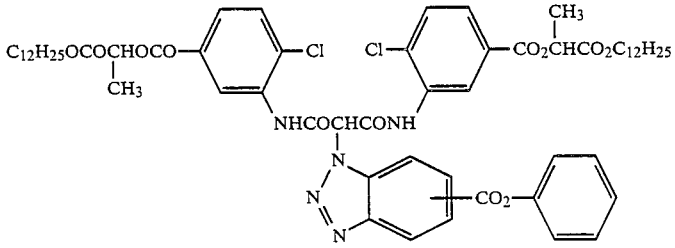

-continued

Cp-12

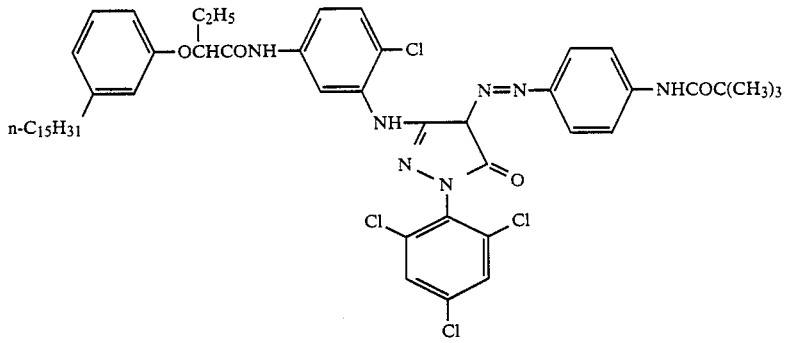

O-3

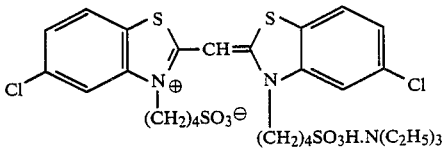

P-1

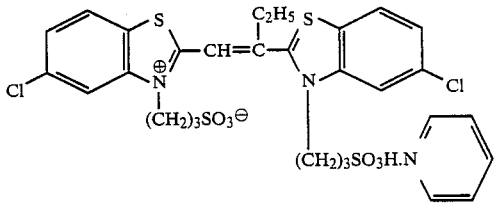

P-2

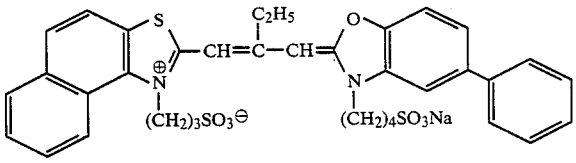

W-1

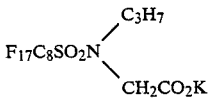

S-1

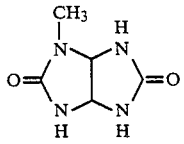

The photographic process employed in this example was performed as follows at 38° C.

| | |
|---|---|
| 1. Color Development | 3 min 15 sec |
| 2. Bleach | 6 min 30 sec |
| 3. Wash | 3 min 15 sec |
| 4. Fix | 6 min 30 sec |
| 5. Wash | 3 min 15 sec |
| 6. Stabilization | 3 min 15 sec |

The compositions of the processing liquids used for the above processing steps were as follows.

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |

-continued

| | |
|---|---|
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleach Solution: | |
| Ammonium Bromide | 160.0 g |
| Aqueous Ammonia (28%) | 25.0 ml |
| Ethylenediaminetetraacetic Acid Sodium Iron Salt | 130.0 g |
| Glacial Acetic Acid | 14.0 ml |
| Water to make | 1 liter |
| Fix Solution: | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 liter |
| Stabilization Solution: | |
| Formalin | 8.0 ml |

-continued

| | |
|---|---|
| Water to make | 1 liter |

EXAMPLE 3

A color photographic material (Sample A) was prepared by forming a first layer (the lowermost layer) to seventh layer (the uppermost layer) as described below on a paper support, both surfaces of which were laminated with polyethylene.

A First Layer: Blue-Sensitive Layer:

A layer containing a silver chlorobromide emulsion (silver bromide content of 80 mole %) at a silver coverage of 400 mg/m$^2$, 600 mg/m$^2$ of a yellow coupler (h), 1,000 mg/m$^2$ of a yellow coupler solvent, dibutyl phthalate, and 1,200 mg/m$^2$ of gelatin.

A Second Layer: Color Mixing Preventing Layer:

A layer containing 1,500 mg/m$^2$ of gelatin

A Third Layer: Green-Sensitive Emulsion Layer:

A layer containing a silver chlorobromide emulsion (silver bromide content of 70 mole %) at a silver coverage of 450 mg/m$^2$, 350 mg/m$^2$ of a magenta coupler (e), 50 mg/m$^2$ of a color mixing preventing agent (f), 100 mg/m$^2$ of a color mixing preventing agent (g), 440 mg/m$^2$ of a magenta coupler solvent, trioctyl phthalate, and 1,000 mg/m$^2$ of gelatin.

A Fourth Layer: Ultraviolet Absorbing Layer:

A layer containing 15 mg/m$^2$ of an ultraviolet absorbent (a), 45 mg/m$^2$ of an ultraviolet absorbent (b), 90 mg/m$^2$ of an ultraviolet absorbent (c), 60 mg/m$^2$ of an ultraviolet absorbent solvent, dibutyl phosphate, and 1,000 mg/m$^2$ of gelatin.

A Fifth Layer: Red-Sensitive Emulsion Layer:

A layer containing a silver chlorobromide emulsion (silver bromide content of 50 mole %) at a silver coverage of 300 mg/m$^2$, 400 mg/m$^2$ of a cyan coupler (d), 20 mg/m$^2$ of an ultraviolet absorbent (a), 50 mg/m$^2$ of an ultraviolet absorbent (b), 60 mg/m$^2$ of an ultraviolet absorbent (c), 240 mg/m$^2$ of a cyan coupler solvent, dibutyl phosphate, and 600 mg/m$^2$ of gelatin.

A Sixth Layer: Ultraviolet Absorbing Layer:

A layer containing 50 mg/m$^2$ of an ultraviolet absorbent (a), 150 mg/m$^2$ of an ultraviolet absorbent (b), 300 mg/m$^2$ of an ultraviolet absorbent (c), 200 mg/m$^2$ of an ultraviolet absorbent solvent, dibutyl phthalate, 1,500 mg/m$^2$ of gelatin.

A Seventh Layer: Protective Layer:

A layer containing 1,500 mg/m$^2$ of gelatin.

The coating composition for the above-described first layer was prepared as follows. That is, 100 g of the yellow coupler (h) shown above was dissolved in a mixture of 166.7 ml of dibutyl phthalate and 200 ml of ethyl acetate and the solution was dispersed in 800 g of an aqueous 10% gelatin solution containing 80 ml of an aqueous solution of 1% sodium dodecylbenzenesulfonate. Then, the emulsified dispersion was mixed with 1,450 g (containing 66.7 g of silver) of a blue-sensitive silver chlorobromide emulsion (bromine content of 80%) to provide the coating liquid. The coating solutions for other layers were also prepared in an analogous manner to that described above. As a hardening agent for each layer, the hardening agent H-19 shown hereinbefore was used.

The spectral sensitizers used for the silver halide emulsions were as follows.

Blue-sensitive emulsion layer:

3.3'-Di(γ-sulfopropyl)selenacyanine sodium salt ($2\times10^{-4}$ mole per mole of silver halide)

Green-sensitive emulsion layer:

3,3'-Di(γ-sulfopropyl)-5,5'-diphenyl-9-ethyloxacarbocyanine sodium salt ($2.5\times10^{-4}$ mole per mole of silver halide)

Red-sensitive emulsion layer:

3,3'-Di(γ-sulfopropyl)-9-methyl-thiadicarbocyanine sodium salt ($2.5\times10^{-4}$ mole per mole of silver halide)

As the irradiation preventing dyes for the silver halide emulsion layers, the following dyes were used. For the green-sensitive emulsion layer:

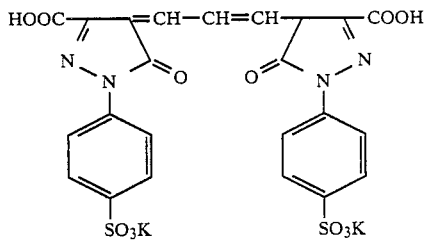

For the red-sensitive emulsion layer:

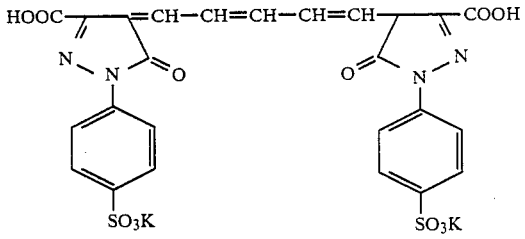

The chemical structures of the compounds (a) to (h) used in the above-described photographic layers of the color photographic material were as follows.

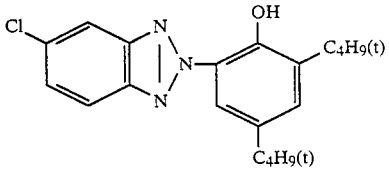

Ultraviolet Absorbent (b):

-continued
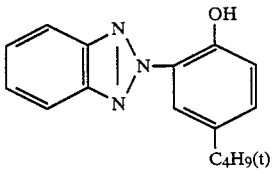
Ultraviolet Absorbent (c):
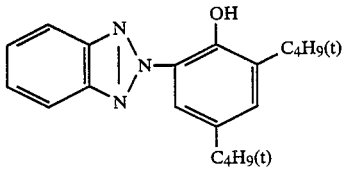
Cyan Coupler (d):
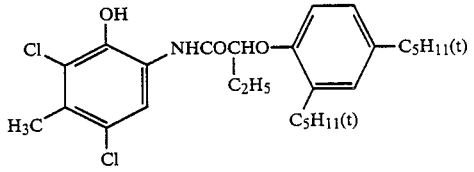
Magenta Coupler (e):
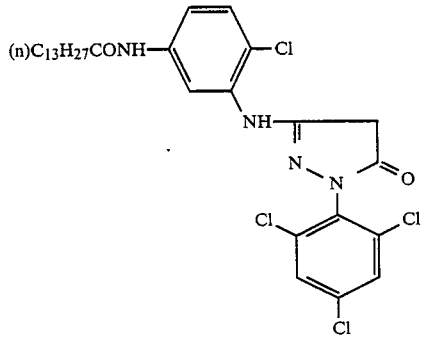
Color Mixing Preventing Agent (f):
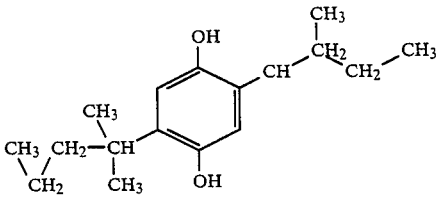
Color Mixing Preventing Agent (g):
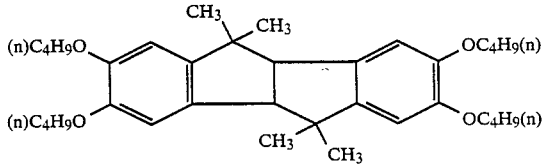
Yellow Coupler (h):

-continued

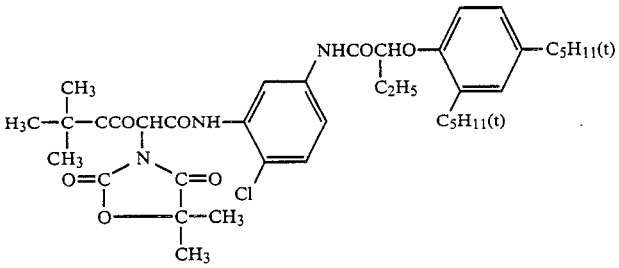

Also, Sample B was prepared by following the same procedure as Sample A except that the magnenta coupler (e) in Sample A was replaced with 300 mg/m$^2$ of magenta coupler M-20 of this invention as illustrated hereinbefore and the coating amount of the silver chlorobromide emulsion was changed to 200 mg/m$^2$.

Each of the samples thus prepared was exposed to green light through a continuous wedge and processed as follows.

| Processing Step | Temperature (°C.) | Time |
|---|---|---|
| Development | 33 | 3 min 30 sec |
| Blix | 33 | 1 min 30 sec |
| Wash | 28 to 35 | 3 min |

The compositions of the processing solutions used for the above processing steps were as follows.

| | |
|---|---|
| Developer: | |
| Benzyl Alcohol | 15 ml |
| Diethylene Glycol | 8 ml |
| Ethylenediaminetetraacetic Acid Disodium Salt | 5 g |
| Sodium Sulfite | 2 g |
| Hydroxylamine Sulfate | 3 g |
| 4-Amino-N—ethyl-N—(β-methanesulfonamidoethyl)-m-toluidine 2/3 Sulfate Monohydrate | 5 g |
| Water to make | 1 liter |
| pH adjusted to | 10.20 |
| Blix Solution: | |
| Ethylenediaminetetraacetic Acid Disodium Salt | 2 g |
| Ethylenediaminetetraacetic Acid Ferric Salt | 40 g |
| Sodium Sulfite | 5 g |
| Ammonium Thiosulfate | 70 g |
| Water to make | 1 liter |
| pH adjusted to | 6.80 |

Then, the colored density of each sample thus processed was measured. The fog, gamma, sensitivity, and maximum density of each sample are shown in Table 3.

TABLE 3

| Test Term | Sample A (Comparison) | Sample B (Invention) |
|---|---|---|
| Fog | 0.12 | 0.12 |
| Gamma | 2.22 | 2.94 |
| Sensitivity | 1.46 | 1.66 |
| Maximum Density | 1.97 | 2.80 |

As is clear from the above results, in the comparison sample, Sample A, the sensitivity and the maximum density were relatively low and a sufficient colored density was not obtained, while in Sample B according to this invention, a sufficient colored density was obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a suport having thereon at least one photosensitive silver halide emulsion layer, wherein a 5-pyrazolone type-2-equivalent magenta dye image-forming coupler is present in the photosensitive silver halide emulsion layer or a layer adjacent thereto and a hardening agent which acts by activating a carboxy group is present in a photosensitive or non-photosensitive photographic layer of the silver halide color photographic material, wherein the 5-pyrazolone type 2-equivalent magenta image-forming coupler is a command represented by formula (A)

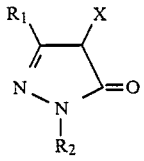

(A)

wherein $R_1$ represents a carbonamido group, an anilino group, or a ureido group; $R_2$ represents an aryl group; and X represents a group capable of being released by the coupling reaction with the oxidation product of an aromatic primary amine developing agent.

2. A silver halide color photographic material as in claim 1, wherein the hardening agent is a compound represented by formula (I)

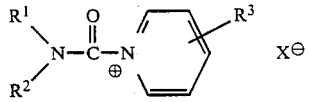

(I)

wherein $R^1$ and $R^2$ each represents an alkyl group having from 1 to 10 carbon atoms, an aryl group having from 6 to 15 carbon atoms, or an aralkyl group having from 7 to 15 carbon atoms, or said $R^1$ and $R^2$ can together form a heterocyclic ring with the nitrogen atom to which $R^1$ and $R^2$ are bonded in formula (I); $R^3$ represents a hydrogen atom, a halogen atom, a carbamoyl group, a sulfo group, a ureido group, an alkoxy group having from 1 to 10 carbon atoms, or an alkyl group having from 1 to 10 carbon atoms; and $X^{\ominus}$ represents an anion; when the hardening agent of the formula (I) forms an intramolecular salt, said $X^{\ominus}$ is not necessary.

3. A silver halide color photographic material as in claim 1, wherein the hardening agent is a compound represented by formula (II)

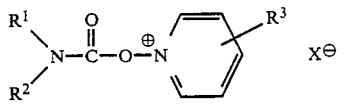

(II)

wherein $R^1$ and $R^2$ each represents an alkyl group having from 1 to 10 carbon atoms, an aryl group having from 6 to 15 carbon atoms, or an aralkyl group having from 7 to 15 carbon atoms, or said $R^1$ and $R^2$ can together form a heterocyclic ring with the nitrogen atom to which $R^1$ and $R^2$ are bonded in formula (II); $R^3$ represents a hydrogen atom, a halogen atom, a carbamoyl group, a sulfo group, a ureido group, an alkoxy group having from 1 to 10 carbon atoms, or an alkyl group having from 1 to 10 carbon atoms; and $X^{\ominus}$ represents an anion; when the hardening agent of the formula (II) forms an intramolecular salt, said $X^{\ominus}$ is not necessary.

4. A silver halide color photographic material as in claim 1, wherein the hardening agent is a compound represented by formula (III)

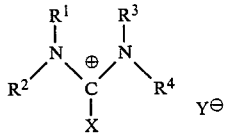

(III)

wherein $R^1$, $R^2$, $R^3$ and $R^4$ each represents an alkyl group having from 1 to 20 carbon atoms, an aralkyl group having from 6 to 20 carbon atoms, or an aryl group having from 5 to 20 carbon atoms; or two groups of said $R^1$, $R^2$, $R^3$ and $R^4$ can together form a ring; X represents a group capable of being released when the compound shown by formula (III) reacts with a nucleophilic reagent; and $Y^{\ominus}$ represents an anion, providing that the anion $Y^{\ominus}$ is not necessary when the hardening agent forms an intramolecular salt.

5. A silver halide color photographic material as in claim 1, wherein the hardening agent is a compound represented by formula (IV)

$$R^1-N=C=N-R^2 \quad \text{(IV)}$$

wherein $R^1$ represents an alkyl group having from 1 to 10 carbon atoms, a cycloalkyl group having from 5 to 8 carbon atoms, an alkoxyalkyl group having from 3 to 10 carbon atoms, or an aralkyl group having from 7 to 15 carbon atoms; $R^2$ represents the same groups as $R^1$, or a group represented by

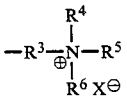

wherein $R^3$ represents an alkylene group having from 2 to 4 carbon atoms; $R^4$ and $R^5$ each represents an alkyl group having from 1 to 6 carbon atoms, or said $R^4$ and $R^5$ can together form a heterocyclic ring with a nitrogen atom; $R^6$ represents an alkyl group having from 1 to 6 carbon atoms; and $X^{\ominus}$ represents an anion; when the hardening agent of formula (IV) forms an intramolecular salt, the counter anion represented by $X^{\ominus}$ is not necessary.

6. A silver halide color photographic material as in claim 1, wherein the hardening agent is a compound represented by formula (V)

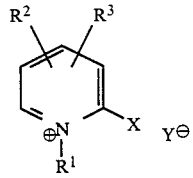

(V)

wherein $R^1$ represents an alkyl group having from 1 to 10 carbon atoms, an aryl group having from 6 to 15 carbon atoms, or an aralkyl group having from 7 to 15 carbon atoms; $R^2$ and $R^3$ each represents a hydrogen atom, a halogen atom, an acylamido group, a nitro group, a carbamoyl group, a ureido group, an alkoxy group, an alkyl group, an alkenyl group, an aryl group, or an aralkyl group, or said $R^2$ and $R^3$ can together form a condensed ring with the pyridinium ring skeleton of formula (V); X represents a group capable of being released when the compound shown by formula (V) reacts with a nucleophilic reagent; and $Y^-$ represents an anion, providing that such the anion is not necessary when the hardening agent forms an intramolecular salt.

7. A silver halide color photographic material as in claim 1, wherein the hardening agent is a compound represented by formula (VI)

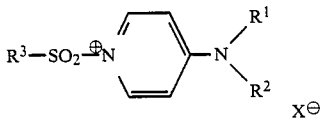

(VI)

wherein $R^1$ and $R^2$ each represents an alkyl group having from 1 to 10 carbon atoms, an aryl group having from 6 to 15 carbon atoms, or an aralkyl group having from 7 to 15 carbon atoms, or said $R^1$ and $R^2$ can together form a heterocyclic ring with the nitrogen atom to which $R^1$ and $R^2$ are bonded in formula (VI); $R^3$ represents an alkyl group having from 1 to 10 carbon atoms, an aryl group having from 6 to 15 carbon atoms, or an aralkyl group having from 7 to 15 carbon atoms; and $X^-$ represents an anion.

8. A silver halide color photographic material as in claim 1, wherein the hardening agent is present in said layer in a range of from 0.01 to 20% by weight with respect to the weight of dry gelatin in the layer.

9. A silver halide color photographic material as in claim 1, wherein the hardening agent is present in said layer in a range of from 0.05 to 10% by weight with respect to the weight of dry gelatin in the layer.

10. A silver halide color photographic material as in claim 1, wherein the coupler is present in an amount in a range of from $2\times10^{-3}$ to 1 mole per mole of silver halide.

11. A silver halide color photographic material as in claim 1, wherein the coupler is present in an amount in a range of from $5\times10^{-3}$ to 0.5 mole per mole of silver halide.

12. A silver halide color photographic material as in claim 1, wherein the non-photosensitive layer is a subbing layer, a backing layer, a filter layer, an interlayer, or an overcoat layer.

13. A silver halide color photographic material as in claim 1, wherein the hardening agent is present in said layer in a range of from 0.01 to 20% by weight with respect to the weight of dry gelatin in the layer and wherein the 2-equivalent magenta dye image-forming coupler is present in an amount in the range of from $2\times10^3$ to 1 mole of silver halide.

* * * * *